US007850489B1

(12) United States Patent
Feldman et al.

(10) Patent No.: US 7,850,489 B1
(45) **Date of Patent: *Dec. 14, 2010**

(54) ELECTRICAL CONNECTOR SYSTEM

(75) Inventors: Steven Feldman, Cedar Park, TX (US); Alexander W. Barr, Austin, TX (US); Joseph N. Castiglione, Cedar Park, TX (US)

(73) Assignee: 3M Innovative Properties Company, St. Paul, MN (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/538,778

(22) Filed: Aug. 10, 2009

(51) Int. Cl.
*H01R 13/648* (2006.01)

(52) U.S. Cl. ..... 439/607.1

(58) Field of Classification Search ..... 439/607.1, 439/607.08, 607.09, 607.11, 607.05, 607.01
See application file for complete search history.

(56) References Cited

U.S. PATENT DOCUMENTS

| | | | | |
|---|---|---|---|---|
| 3,587,028 | A | 6/1971 | Uberbacher | |
| 4,707,045 | A | 11/1987 | Ney et al. | |
| 5,114,355 | A | 5/1992 | Kimmel et al. | |
| 5,184,965 | A | 2/1993 | Myschik et al. | |
| 5,194,020 | A | 3/1993 | Voltz | |
| 5,496,183 | A | 3/1996 | Soes et al. | |
| 5,516,294 | A * | 5/1996 | Andrews et al. | 439/63 |
| 5,645,450 | A | 7/1997 | Yamada et al. | |
| 5,782,656 | A | 7/1998 | Zell et al. | |
| 5,842,872 | A | 12/1998 | Hosler, Sr. et al. | |
| 5,904,594 | A | 5/1999 | Longueville et al. | |
| 5,906,511 | A | 5/1999 | Bozzer et al. | |
| 5,980,321 | A | 11/1999 | Cohen et al. | |
| 5,993,259 | A | 11/1999 | Stokoe et al. | |
| 6,056,559 | A | 5/2000 | Olson | |
| 6,146,202 | A | 11/2000 | Ramey et al. | |

(Continued)

FOREIGN PATENT DOCUMENTS

EP 0 670 082 B1 9/1995

(Continued)

OTHER PUBLICATIONS

Product Literature: Amphenol TCS, VHDM Connector, 6 pages, (date unknown but before filing date of present application).

(Continued)

*Primary Examiner*—T C Patel
*Assistant Examiner*—Phuong Nguyen
(74) *Attorney, Agent, or Firm*—Johannes P. M. Kusters

(57) ABSTRACT

An electrical connector system includes an electrical connector assembly and an electrical connector. The electrical connector assembly includes an insulative carrier and a plurality of termination devices supported in the insulative carrier. The electrical connector includes a plurality of interlocking plates defining a plurality of cavities and at least one electrical contact positioned within a cavity. The at least one electrical contact is electrically isolated from the interlocking plates and configured to mate with a socket contact of the termination device. The electrical connector assembly and the electrical connector are configured such that the socket contact of each termination device makes electrical contact with a corresponding electrical contact of the electrical connector and the shield element of each termination device makes electrical contact with the interlocking plates of the electrical connector when the electrical connector assembly and the electrical connector are in a mated configuration.

10 Claims, 29 Drawing Sheets

U.S. PATENT DOCUMENTS

| | | | | |
|---|---|---|---|---|
| 6,231,391 | B1 | 5/2001 | Ramey et al. | |
| 6,238,245 | B1 | 5/2001 | Stokoe et al. | |
| 6,299,483 | B1 | 10/2001 | Cohen et al. | |
| 6,358,062 | B1 | 3/2002 | Feldman et al. | |
| 6,368,120 | B1 | 4/2002 | Scherer et al. | |
| 6,371,813 | B2 | 4/2002 | Ramey et al. | |
| 6,379,188 | B1 | 4/2002 | Cohen et al. | |
| 6,447,328 | B1 | 9/2002 | Feldman | |
| 6,503,103 | B1 | 1/2003 | Cohen et al. | |
| 6,506,076 | B2 | 1/2003 | Cohen et al. | |
| 6,520,802 | B1 | 2/2003 | Mitra | |
| 6,551,126 | B1 | 4/2003 | Feldman | |
| 6,554,647 | B1 | 4/2003 | Cohen et al. | |
| 6,607,402 | B2 | 8/2003 | Cohen et al. | |
| 6,712,646 | B2 | 3/2004 | Shindo | |
| 6,833,513 | B1 | 12/2004 | Ahmad | |
| 6,971,916 | B2 * | 12/2005 | Tokunaga | 439/607.09 |
| 6,992,544 | B2 | 1/2006 | Barnes et al. | |
| 7,048,585 | B2 | 5/2006 | Milbrand, Jr. et al. | |
| 7,114,964 | B2 | 10/2006 | Winings et al. | |
| 7,144,240 | B2 * | 12/2006 | Maravilla | 425/178 |
| 7,553,187 | B2 * | 6/2009 | Feldman et al. | 439/607.17 |
| 7,607,944 | B2 | 10/2009 | Yoshioka et al. | |
| 7,744,414 | B2 * | 6/2010 | Scherer et al. | 439/607.05 |
| 2001/0005654 | A1 | 6/2001 | Cohen et al. | |
| 2007/0141871 | A1 | 6/2007 | Scherer et al. | |
| 2008/0020615 | A1 | 1/2008 | Feldman et al. | |
| 2009/0104800 | A1 | 4/2009 | Scherer | |
| 2009/0104809 | A1 * | 4/2009 | Feldman et al. | 439/374 |
| 2010/0009571 | A1 | 1/2010 | Scherer et al. | |
| 2010/0062629 | A1 | 3/2010 | Feldman et al. | |

FOREIGN PATENT DOCUMENTS

| | | |
|---|---|---|
| WO | WO 94/11926 | 5/1994 |

OTHER PUBLICATIONS

Product Literatue: 3M MetPak™ HSHM Backplane Connectors, Innovation HSHM Brochure, 3M Electronic and Interconnect Solutions Division, Austin, TX, 4 pages, Copyright 3M 2002.

Product Literature: 3M™ High Density Shielded Controlled Impedance (HDSCI), 3M Electronic Solutions Division Interconnect Solutions, 1 page (date unknown but before filing date of present application).

Feldman et al., Electrical Connector System, U.S. Appl. No. 12/538,743, filed Aug. 10, 2009.

Feldman et al., Electrical Connector System, U.S. Appl. No. 12/538,637, filed Aug. 10, 2009.

* cited by examiner

ELECTRICAL CONNECTOR SYSTEM

TECHNICAL FIELD

The present disclosure relates to high speed electrical connectors. In particular, the present invention relates to electrical connectors that provide high signal line density while also providing shielded controlled impedance (SCI) for the signal lines.

BACKGROUND

Interconnection of integrated circuits to other circuit boards, cables or electronic devices is known in the art. Such interconnections typically have not been difficult to form, especially when the signal line densities have been relatively low, and when the circuit switching speeds (also referred to as signal risetime) have been slow when compared to the length of time required for a signal to propagate through a conductor in the interconnect or in the printed circuit board. As user requirements grow more demanding with respect to both interconnect sizes and signal risetime, the design and manufacture of interconnects that can perform satisfactorily in terms of both physical size and electrical performance has grown more difficult.

Connectors have been developed to provide the necessary impedance control for high speed circuits, i.e., circuits with a transmission frequency of at least 5 GHz. Although many of these connectors are useful, there is still a need in the art for connector designs having increased signal line densities with closely controlled electrical characteristics to achieve satisfactory control of the signal integrity.

SUMMARY

In one aspect, the present invention provides an electrical connector assembly including an insulative carrier and a plurality of termination devices supported in the insulative carrier. Each termination device includes an electrically conductive outer shield element having a front end and a back end, the shield element having a latch member extending therefrom and a plurality of termination legs extending from the back end, an insulator disposed within the shield element, and a socket contact supported within and electrically isolated from the shield element by the insulator. The socket contact is configured for making electrical connections through the front end and back end of the shield element and has a termination end extending beyond the back end of the shield element.

In another aspect, the present invention provides a tool suitable for use with an insulative carrier having a plurality of carrier walls including a plurality of wall portions and defining an array of apertures shaped to receive a plurality of termination devices. The tool includes a body portion and a head portion. The head portion extends from the body portion and is shaped for insertion into the carrier. The head portion includes a channel shaped to receive and remove a wall portion of the carrier.

In another aspect, the present invention provides an electrical connector system including an electrical connector assembly and an electrical connector. The electrical connector assembly includes an insulative carrier and a plurality of termination devices supported in the insulative carrier. Each termination device includes an electrically conductive outer shield element having a front end and a back end, the shield element having a latch member extending therefrom and a plurality of termination legs extending from the back end, an insulator disposed within the shield element, and a socket contact supported within and electrically isolated from the shield element by the insulator. The socket contact is configured for making electrical connections through the front end and back end of the shield element and has a termination end extending beyond the back end of the shield element. The electrical connector includes a plurality of interlocking plates defining a plurality of cavities and at least one electrical contact positioned within a cavity. Each cavity is sized for accepting a termination device. At least one of the plurality of interlocking plates is electrically conductive. The at least one electrical contact is electrically isolated from the interlocking plates and configured to mate with a socket contact of the termination device. The electrical connector assembly and the electrical connector are configured such that the socket contact of each termination device makes electrical contact with a corresponding electrical contact of the electrical connector and the shield element of each termination device makes electrical contact with the interlocking plates of the electrical connector when the electrical connector assembly and the electrical connector are in a mated configuration.

The above summary of the present invention is not intended to describe each disclosed embodiment or every implementation of the present invention. The Figures and detailed description that follow below more particularly exemplify illustrative embodiments.

BRIEF DESCRIPTION OF THE DRAWINGS

FIGS. 33*a*-33*h* are top views illustrating the customization of the carrier of the electrical connector assembly of FIG. 20 using the tool illustrated in FIG. 32.

DETAILED DESCRIPTION

In the following detailed description of the preferred embodiments, reference is made to the accompanying drawings that form a part hereof. The accompanying drawings show, by way of illustration, specific embodiments in which the invention may be practiced. It is to be understood that other embodiments may be utilized, and structural or logical changes may be made without departing from the scope of the present invention. The following detailed description, therefore, is not to be taken in a limiting sense, and the scope of the invention is defined by the appended claims.

Figure 1:
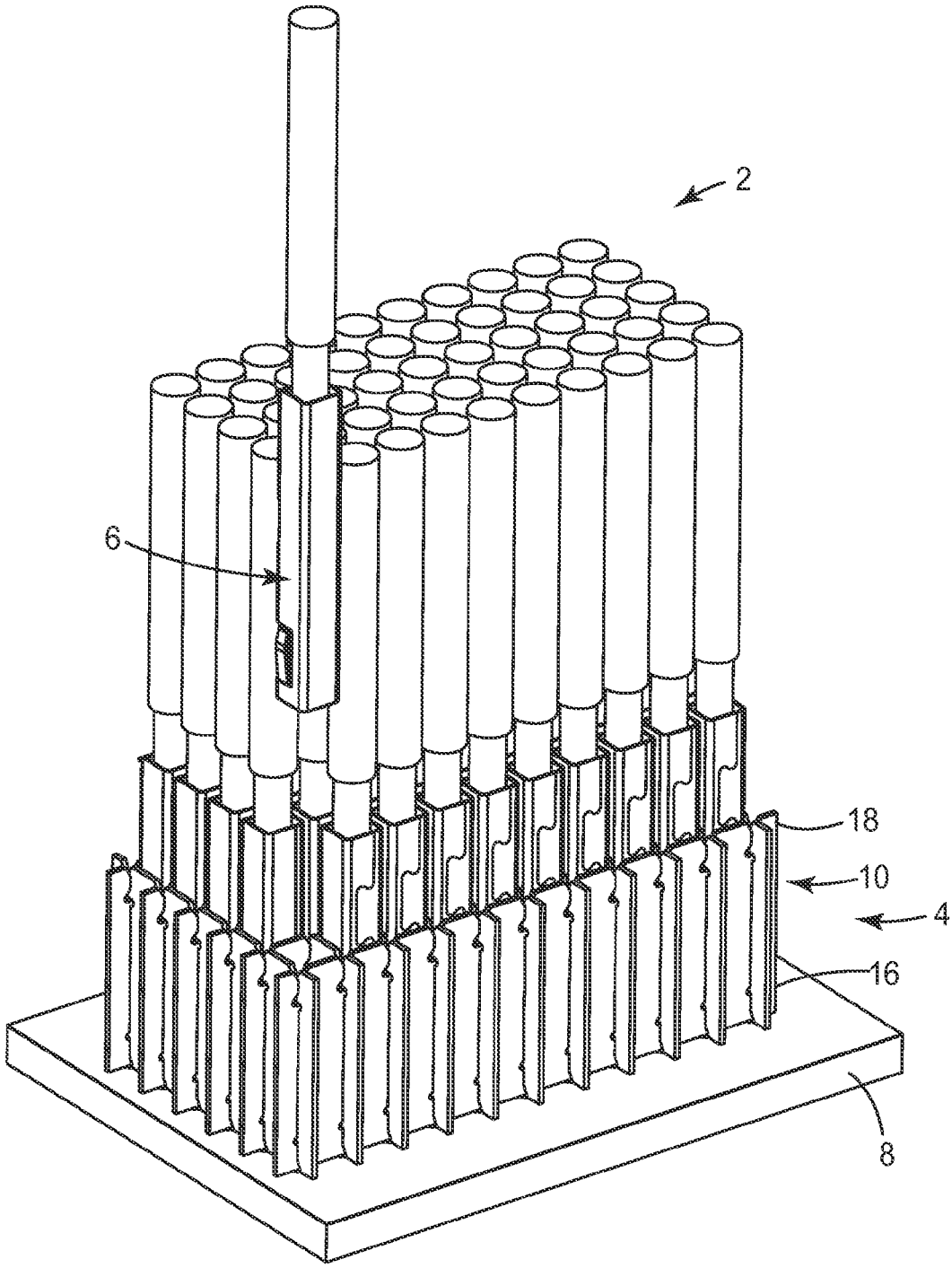
FIG. 1 is a partially exploded perspective view of an exemplary embodiment of an electrical connector system according to an aspect of the present invention.
Figure 2:
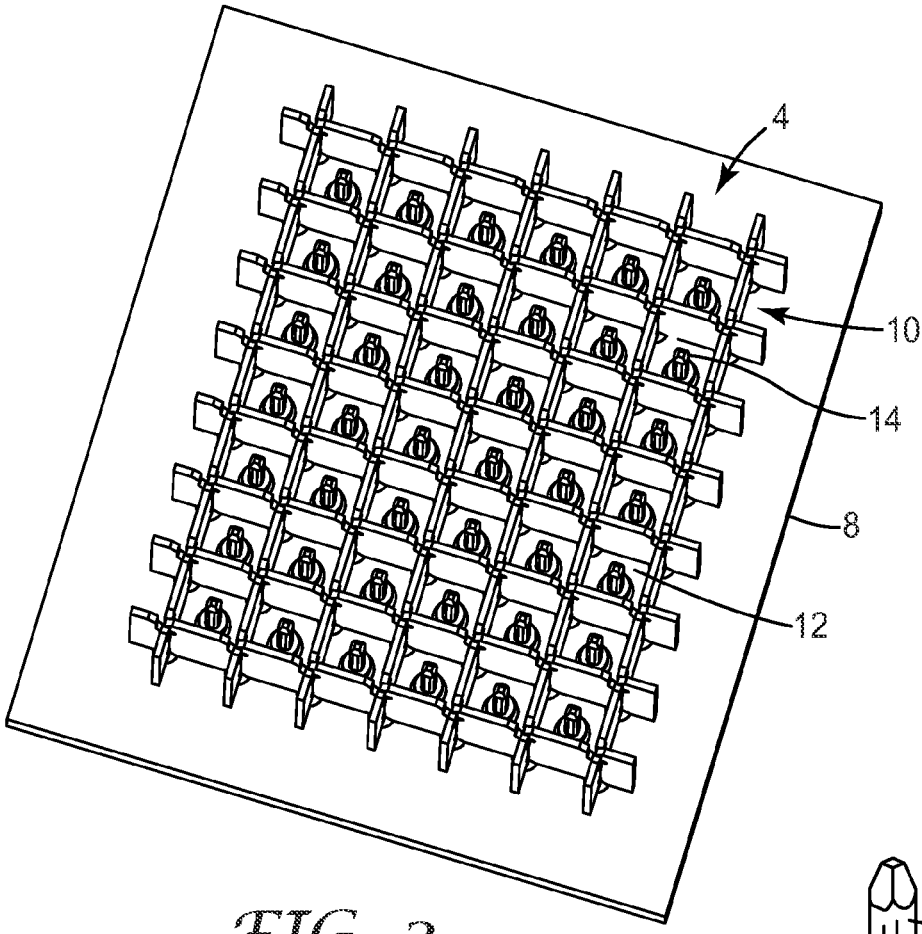
FIG. 2 is a perspective view of the electrical connector of the electrical connector system of FIG. 1.

Referring now to the Figures, FIG. 1 illustrates an exemplary embodiment of an electrical connector system according to an aspect of the present invention. Electrical connector system 2 includes an electrical connector 4 and a plurality of termination devices 6 configured to mate with electrical connector 4. Electrical connector 4 may be connected to a circuit substrate, such as e.g., a printed circuit board 8. Referring to FIG. 2, electrical connector 4 includes a plurality of free-standing interlocking plates 10 defining a plurality of cavities 12. Each cavity 12 is sized for accepting a termination device 6. Electrical connector 4 further includes a plurality of electrical contacts 14. Each electrical contact 14 is positioned within a cavity 12, electrically isolated from interlocking plates 10 and configured to mate with a socket contact of a termination device 6 (described below).

At least one of interlocking plates 10 is electrically conductive and provides a ground connection between termination devices 6 and printed circuit board 8. Generally, interlocking plates 10 may be electrically conductive or insulative. Interlocking plates 10 may be resilient to enable interlocking, i.e., interlocking plates 10 may compliantly deflect away from each other during latching and return substantially to their original shape after latching. Referring back to FIG. 1, interlocking plates 10 include a terminal end 16 for terminating to printed circuit board 8 and a mating end 18 for electrically contacting an electrically conductive outer shield element of a termination device 6 (described below). In a preferred embodiment, interlocking plates are metal plates formed by any suitable method, such as e.g., metal stamping. In other embodiments, interlocking plates 10 are formed by other means, including molding and/or machining of polymeric material, molding and/or machining of metal, or construction of a metal frame overmolded with a polymeric material.

Figure 3:
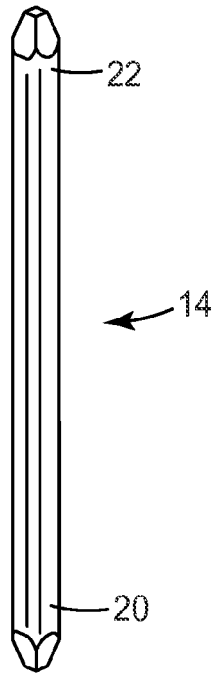
FIG. 3 is a perspective view of an electrical contact of the electrical connector of FIG. 2.

Referring to FIG. 3, electrical contacts 14 include a terminal end 20 for terminating to printed circuit board 8 and a mating end 22 for electrically contacting a socket contact of a termination device 6 (described below).

Figure 4:
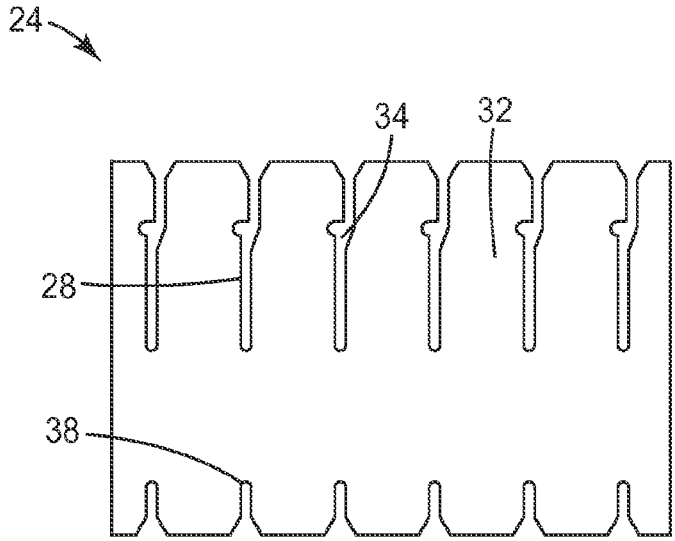
FIG. 4 is a front view of a first plate of the electrical connector of FIG. 2.
Figure 5:
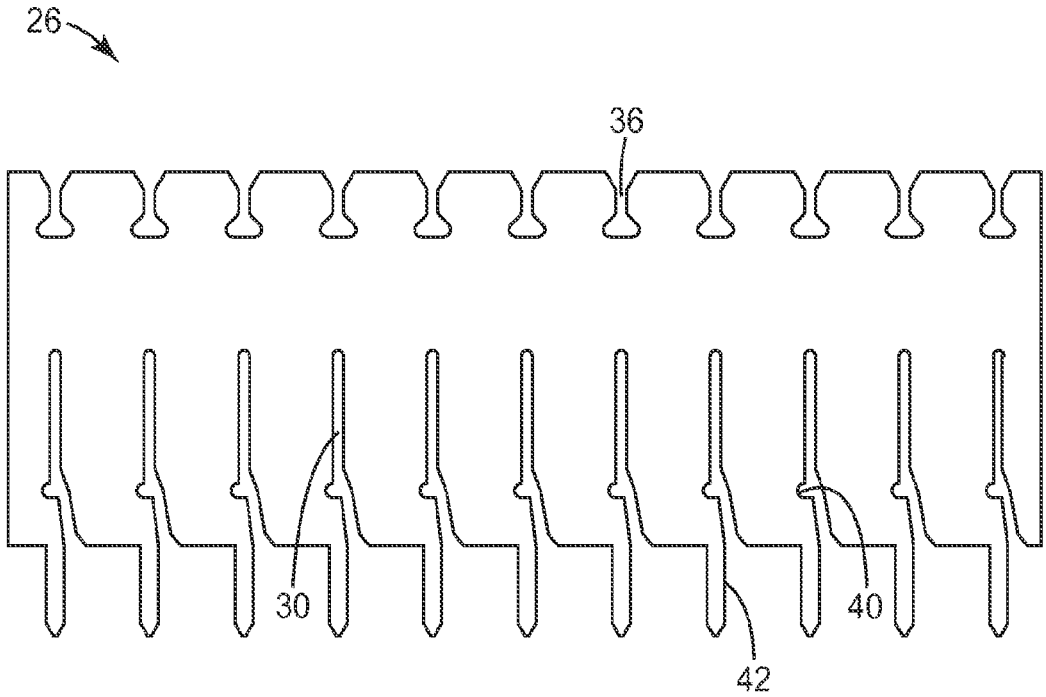
FIG. 5 is a front view of a second plate of the electrical connector of FIG. 2.
Figure 6:
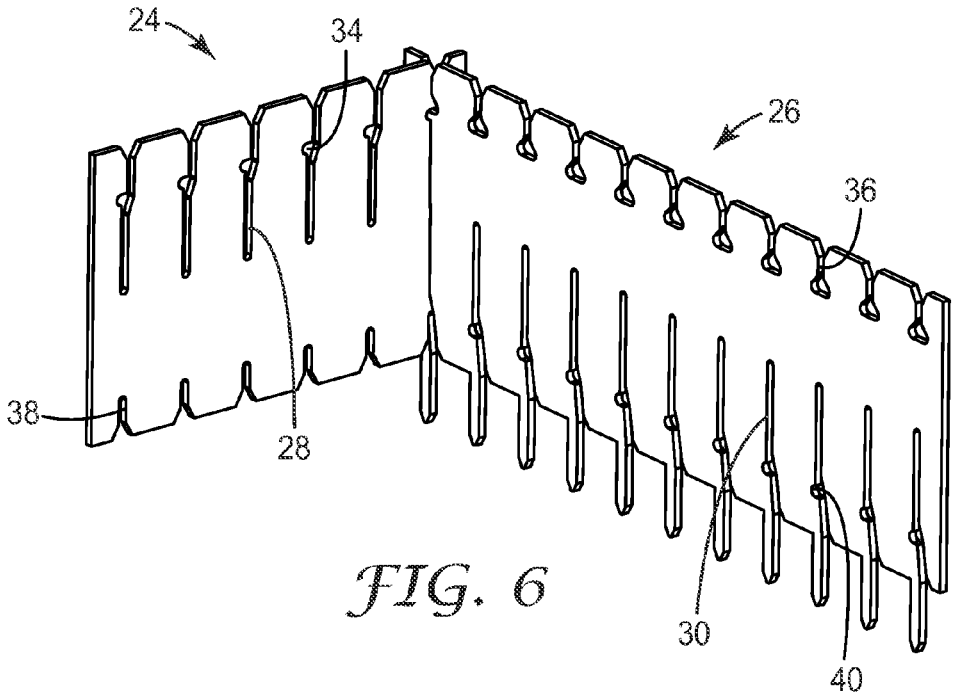
FIG. 6 is a perspective view of an assembly of a first plate and a second plate of the electrical connector of FIG. 2.

In the illustrated embodiment, interlocking plates 10 include a plurality of first plates 24 (FIG. 4) and a plurality of second plates 26 (FIG. 5). Second plates 26 are transversely positioned and interconnected with respect to first plates 24 by upward interlocking first slot 28 and downward interlocking second slot 30, respectively, as illustrated in FIG. 6, such that when assembled, the plurality of first plates 24 and second plates 26 define the plurality of cavities 12.

Referring to FIG. 4, first plate 24 includes upward interlocking first slots 28 which separate alignment arms 32 which fit between second plates 26, and interlock with downward interlocking second slots 30 when the array of first plates 24 and second plates 26 are intermeshed to form interlocking plates 10. The end of each alignment arm 32 defines a first latch element 34 that interlocks with guide slot 36 of second plate 26. First latch elements 34 hold their respective alignment arms 32 in position, and prevent inadvertent bending of alignment arms 32 during handling and insertion of termination devices 6 into cavities 12. First plate 24 further includes engagement slot 38, which interlocks with second latch element 40 of second plate 26 when first plate 24 and second plate 26 are assembled together. As can be seen in FIG. 6, the interlocking of first latch elements 34 and second latch elements 40 with guide slots 36 and engagement slots 38, respectively, keep first plates 24 and second plates 26 assembled together.

Referring to FIG. 5, second plate 26 is illustrated. Second plate 26 includes a plurality of guide slots 36 for capturing first latch elements 34 as second plates 26 are engaged with first plates 24 (FIG. 4). In particular, guide slots 36 are shaped to capture and hold first latch elements 34 of first plate 24 during assembly of second plates 26 and first plates 24. The optional enlarged opening at the base of guide slot 36 can assist in capturing and guiding first latch elements 34. Second plate 26 further optionally includes a plurality of terminals 42, which may be inserted into printed circuit board 8 for through-hole solder termination. Alternatively, terminals 42 may be configured for surface mounting or may be press-fit compliant pins. Terminals 42 are preferably aligned beneath downward interlocking second slots 30 to provide a symmetrical printed circuit board pad pattern when interlocking plates 10 are attached to printed circuit board 8.

Figure 7:
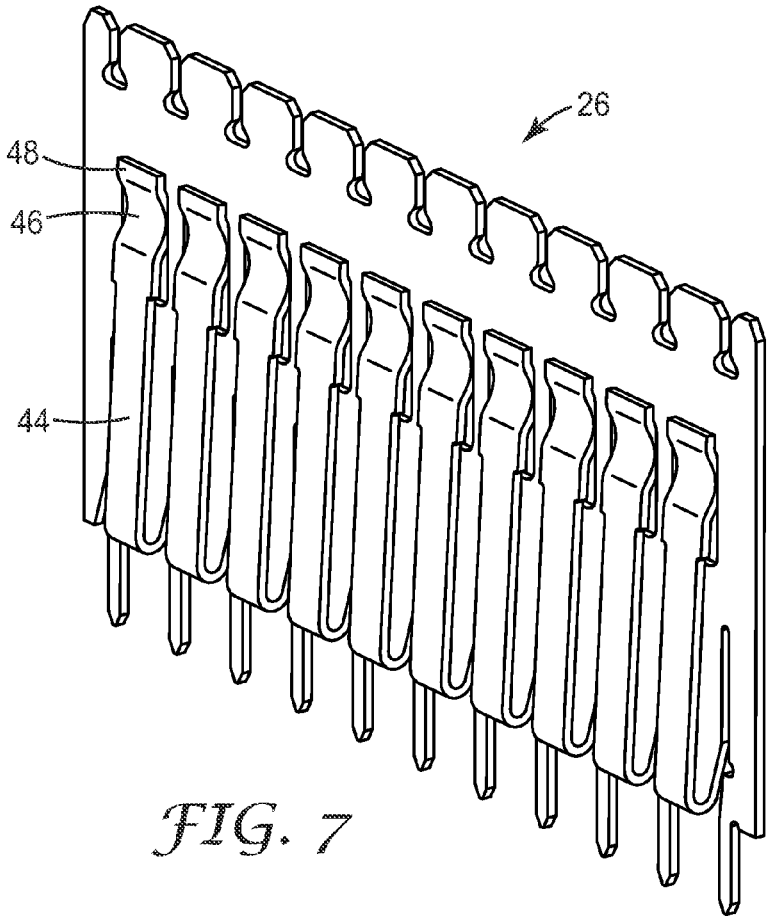
FIG. 7 is a perspective view of an exemplary embodiment of a second plate including a latch depressor that can be used in the electrical connector of FIG. 2.
Figure 8A:
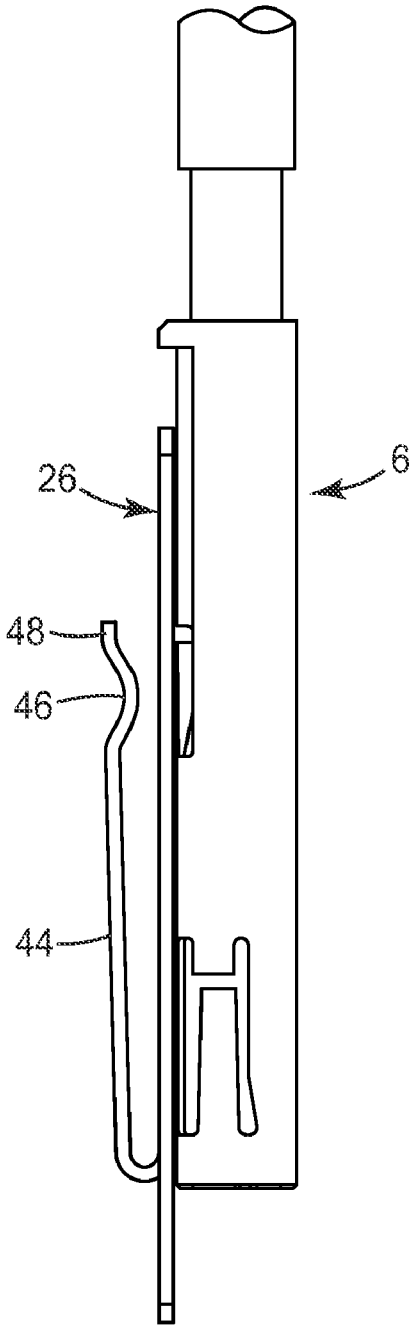
FIGS. 8*a*-8*b* are side views of the second plate of FIG. 7 illustrating the operation of the latch depressor.
Figure 8B:
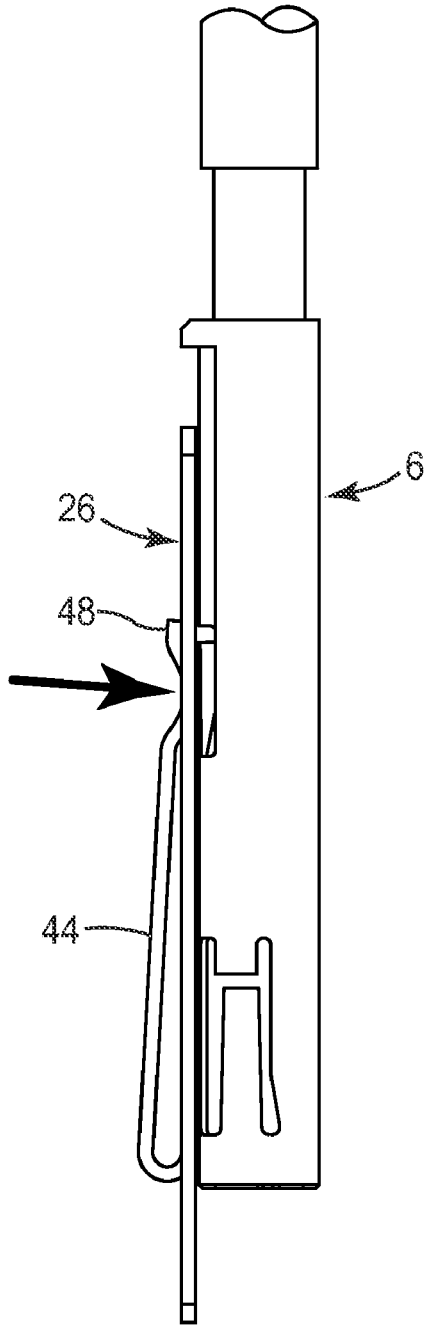

Referring to FIG. 7, electrical connector 4 further optionally includes a plurality of latch depressors 44. Each latch depressor 44 is configured to unlatch a corresponding termination device 6 from interlocking plates 10. Latch depressors 44 may be assembled to or integrally formed with the plurality of interlocking plates 10. In the embodiment illustrated in FIG. 7, latch depressors 44 are integrally formed with second plates 26 of interlocking plates 10. FIGS. 8*a*-8*b* illustrate the operation of a latch depressor 44. FIG. 8*a* illustrates latch depressor 44 in the original position and FIG. 8*b* illustrates latch depressor 44 in the actuated position. Latch depressor 44 is designed to resiliently deflect from the original position to the actuated position. Latch depressor 44 includes an actuation dimple 46 configured to push against a latch element of an electrically conductive outer shield element of a termination device 6 (described below) to release termination device 6 from electrical connector 4. In one embodiment, actuation dimple 46 has a non-skid cup-shape to help prevent a release tool or human finger pressing against latch depressor 44 (represented by the arrow in FIG. 8*b*) from slipping off latch depressor 44, thereby possibly damaging electrical connector 4. Latch depressor 44 further includes a stop tab 48 configured to prevent overtravel of latch depressor 44. Overtravel of latch depressor 44 may result in damage of the latch element of the electrically conductive outer shield element of termination device 6. To prevent overtravel of latch depressor 44, stop tab 48 abuts second plate 26 during actuation of latch depressor 44, as illustrated in FIG. 8*b*. Latch depressor 44 may be sized such that interlocking plates 10 position and guide latch depressor 44 during actuation.

Figure 9:
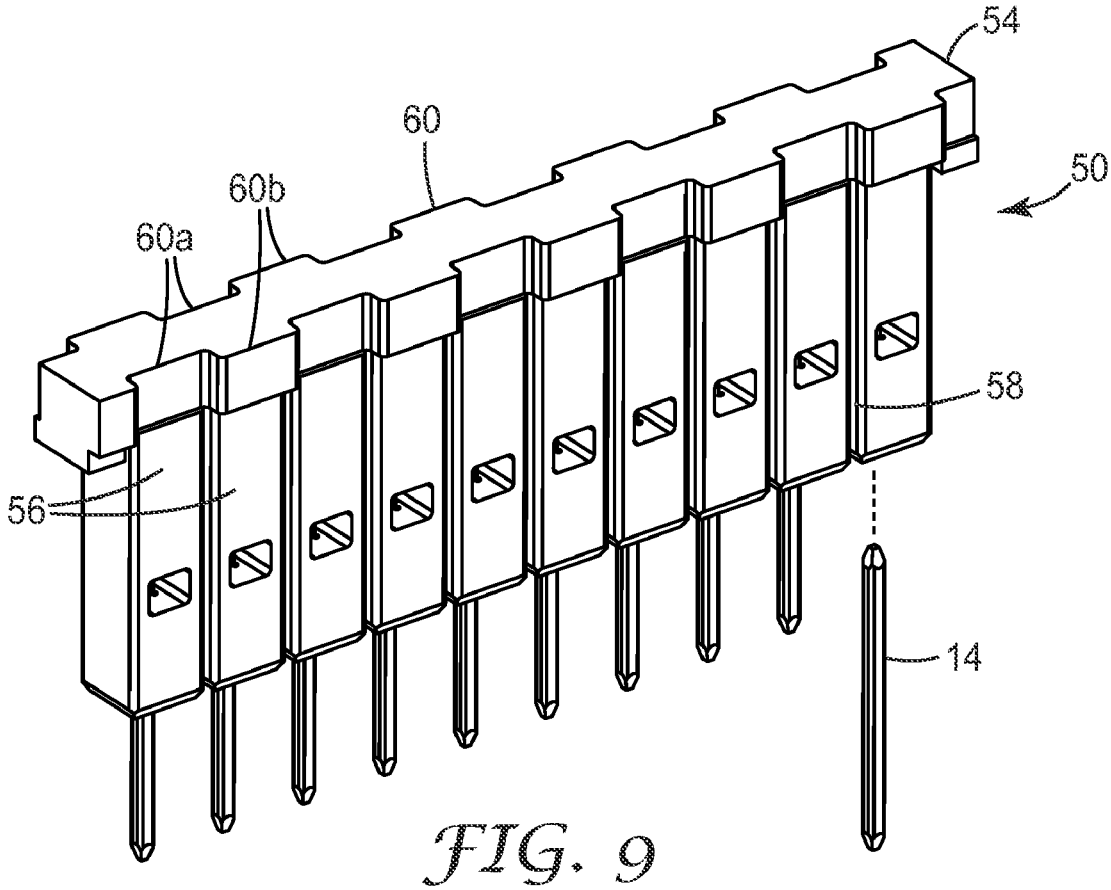
FIG. 9 is a partially exploded perspective view of an exemplary embodiment of an insertion element that can be used in the electrical connector of FIG. 2.
Figure 10:
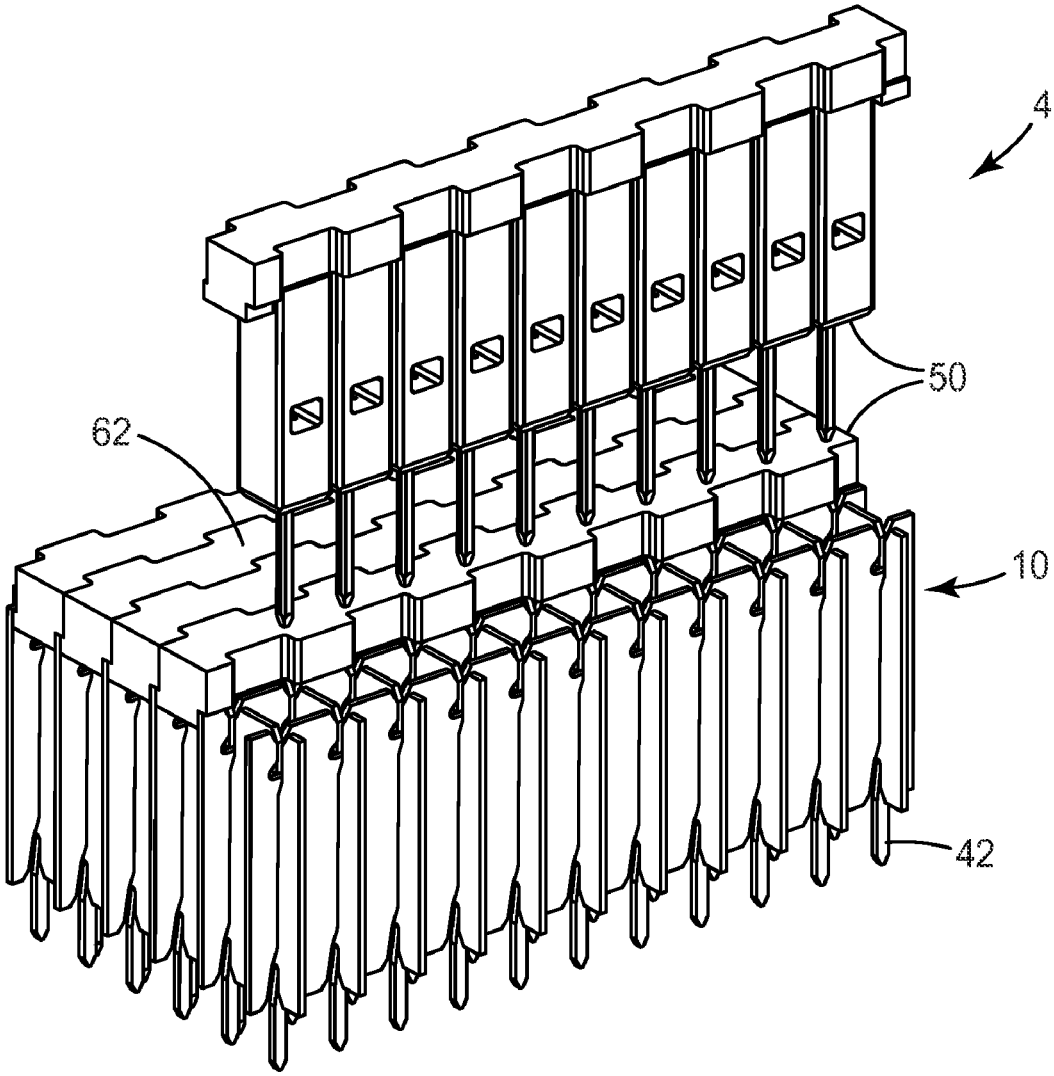
FIG. 10 is a partially exploded perspective view of the electrical connector of FIG. 2 including a plurality of insertion elements.

FIG. 9 illustrates an exemplary embodiment of a removable insertion element 50. Insertion element 50 is configured to assist in terminating electrical connector 4 to printed circuit board 8. In one embodiment, insertion element 50 is configured to hold at least one electrical contact 14. In one embodiment, insertion element 50 is configured to hold a plurality of linearly aligned electrical contacts 14. Insertion element 50 includes a base 54 and at least one post 56 extending from base 54. Each post 56 is configured to hold at least one electrical contact 14 within a cavity 12. In use, post 56 is inserted into cavity 12, and base 54 remains above cavity 12. Base 54 may optionally include a lip or other feature that prevents it from being inserted into cavity 12. If insertion element 50 holds two or more electrical contacts 14, it includes a separation slot 58 between adjacent posts 56. Separation slot 58 accommodates the portion of interlocking plates 10 that forms the common wall of adjacent cavities 12 into which adjacent posts 56 are inserted. Base 54 may be any suitable shape that allows additional insertion elements 50 to be inserted in adjacent cavities. One suitable shape for an insertion element 50 holding multiple electrical contacts 14 is shown in FIG. 9 in which each base 54 includes a staggered profile 60 with alternating indentations 60*a* and mirror image protrusions 60*b* such that adjacent insertion elements 50 interdigitate as illustrated in FIG. 10 to form a stable, rigid structure, preferably having a flat top surface 62. This stability can aid in preventing electrical connector 4 from becoming deformed prior to being placed on printed circuit board 8. If the top surface of the insertion elements 50 is flat, the plurality of insertion elements 50 provides a means for applying the high force used for compliant pin insertion, e.g. Suitable indentation (and mirror image protrusion) shapes include an arc, a semi-circle, a sine wave, a square wave, a "V" shape, multiple indentations, etc.

Figure 11:
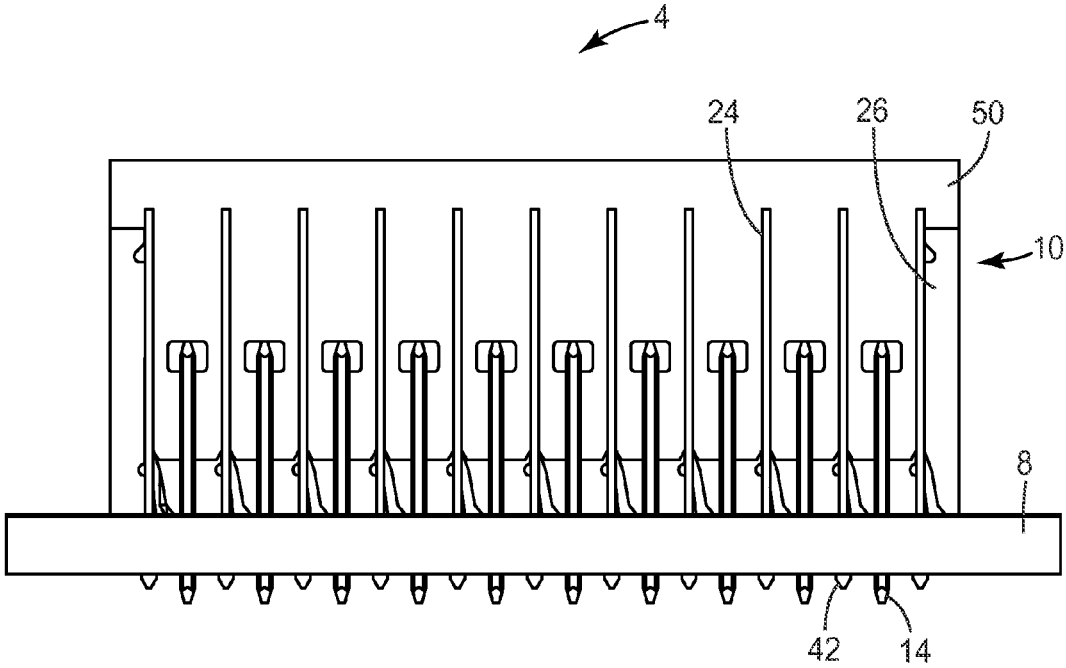
FIG. 11 is a front cross-sectional view of the electrical connector of FIG. 2 including a plurality of insertion elements.

As is illustrated in FIGS. 6-7, insertion element 50 is used to insert electrical contacts 14 into interlocking plates 10 and to hold them within interlocking plates 10, preferably until interlocking plates 10 and the electrical contacts 14 are mounted to printed circuit board 8. Insertion element 50 serves a number of purposes: it keeps electrical contacts 14 normal to the surface of printed circuit board 8 during soldering; in some embodiments it provides a bearing surface for pressing terminals 42 into through-holes in the surface of printed circuit board 8; and it protects mating end 22 of unmated electrical contacts 14 from exposure to debris and damage. As shown in FIG. 11, insertion element 50 is shaped to provide a clearance distance between insertion element 50 and printed circuit board 8, e.g., to allow solder flux gases and heat to escape during the process of assembling electrical connector 4 to printed circuit board 8. Once the interlocking plates 10 and electrical contacts 14 have been suitably attached to printed circuit board 8, insertion element 50 may be removed and discarded or re-used. Upon removal of insertion element 50, electrical connector 4 is ready to receive termination devices 6 for connection with electrical contacts 14. As shown in FIG. 11, electrical connector 4 is used in conjunction with printed circuit board 8 using a through-hole connection.

The modularity of insertion elements 50 also allows for easy customization. Electrical contacts 14 can be left out of any desired positions in electrical connector 4 and on printed circuit board 8 simply by leaving the appropriate posts 56 of insertion element 50 empty. Additionally, the number of column and row positions in electrical connector 4 can be easily reduced by cutting off portions of interlocking plates 10 prior to assembly. Electrical contacts 14 can then be placed only in the appropriate sections of insertion element 50. All of the components of electrical connectors 4 according to aspects of the present invention can be easily assembled by hand without any special tooling, thereby making them ideal for custom applications.

Figure 12:
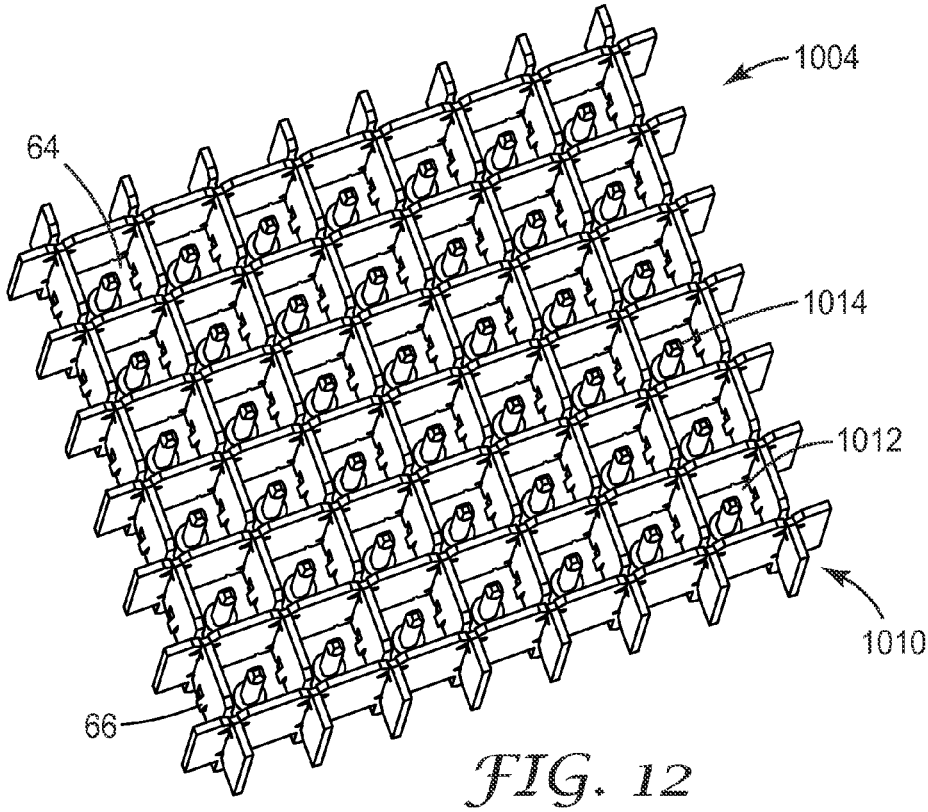
FIG. 12 is a perspective view of another embodiment of an electrical connector according to an aspect of the present invention.

FIG. 12 illustrates another exemplary embodiment of an electrical connector according to an aspect of the present invention. Electrical connector 1004 includes an insulative support wafer 64 and a plurality of interlocking plates 1010 defining a plurality of cavities 1012. Each cavity 1012 is sized for accepting a termination device 6. Electrical connector 1004 further includes a plurality of electrical contacts 1014. Each electrical contact 1014 is positioned within a cavity 1012 supported by support wafer 64, electrically isolated from interlocking plates 1010, and configured to mate with a socket contact of a termination device 6 (described below).

Figure 13:
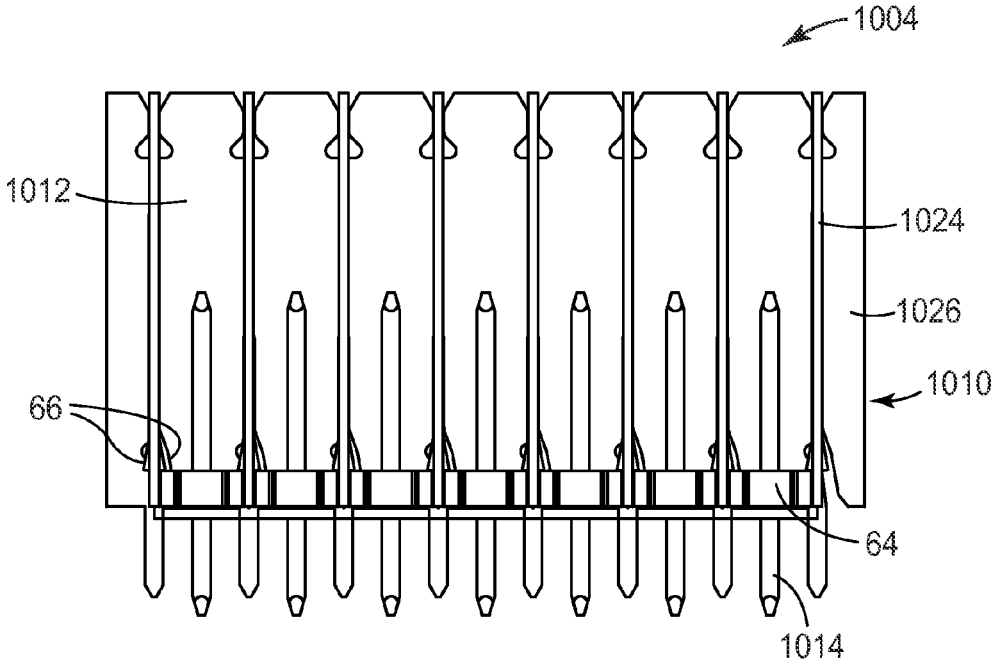
FIG. 13 is a front cross-sectional view of the electrical connector of FIG. 12.
Figure 16:
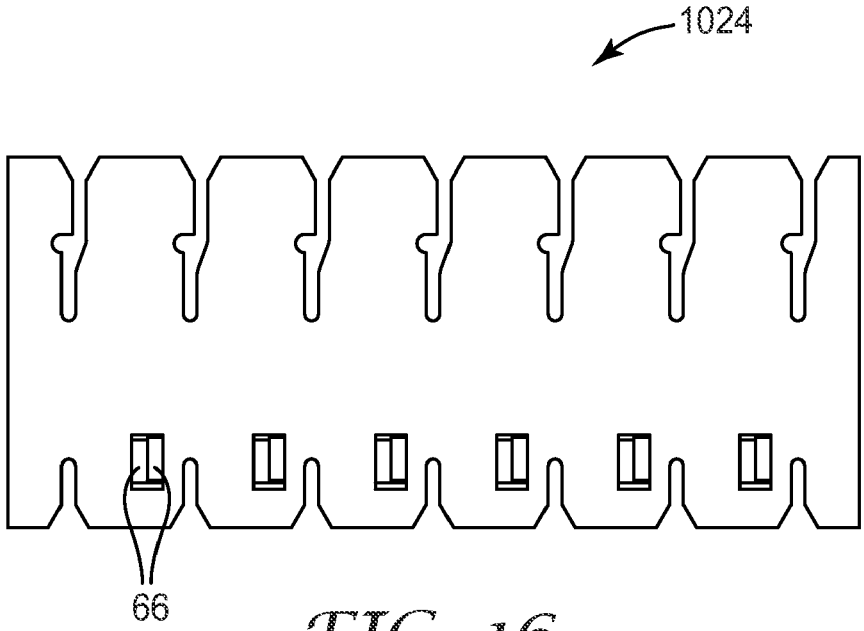
FIG. 16 is a front view of a first plate of the electrical connector of FIG. 12.
Figure 17:
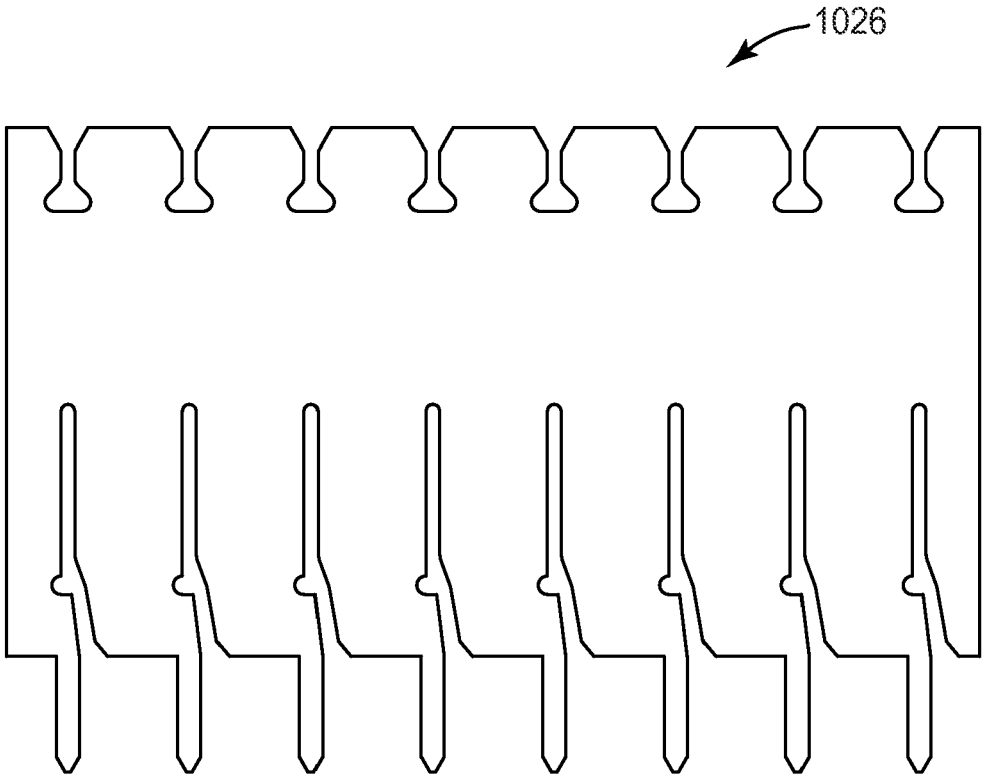
FIG. 17 is a front view of a second plate of the electrical connector of FIG. 12.
Figure 18:
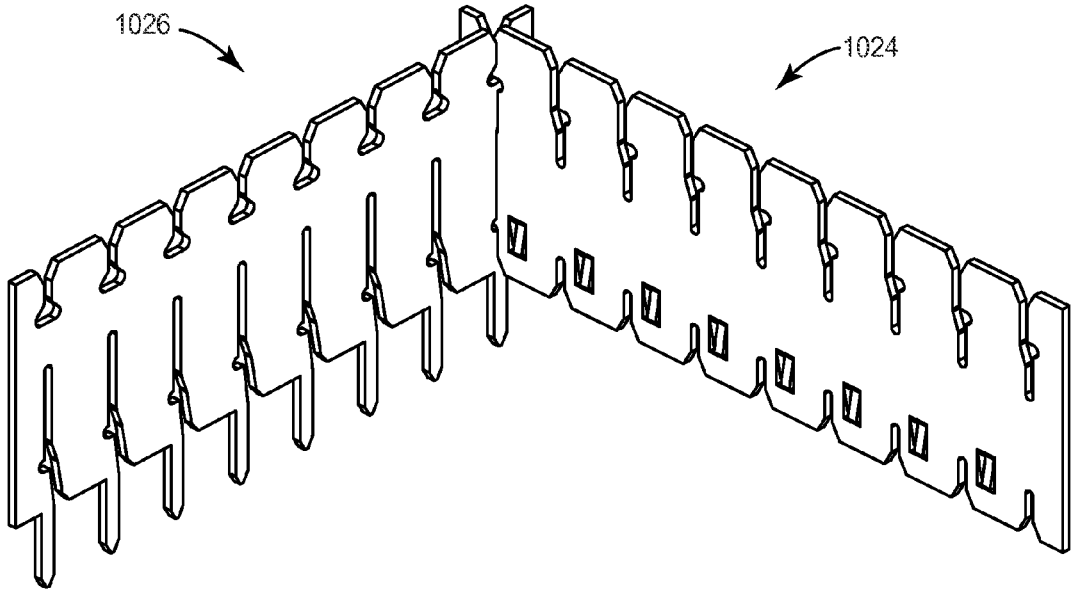
FIG. 18 is a perspective view of an assembly of a first plate and a second plate of the electrical connector of FIG. 12.

Interlocking plates 1010 are similar to free-standing interlocking plates 10 described above. Whereas interlocking plates 10 are free-standing, interlocking plates 1010 are attached to support wafer 64. Interlocking plates 1010 include a plurality of first plates 1024 (FIG. 16) and a plurality of second plates 1026 (FIG. 17). First plates 1024 are similar to first plates 24 described above. Compared to first plates 24, first plates 1024 additionally include a plurality of stop tabs 66. Stop tabs 66 are configured to position support wafer 64 with respect to interlocking plates 1010. Stop tabs 66 prevent support wafer 64 from being over-inserted into interlocking plates 1010 during assembly. As illustrated in FIG. 13, support wafer 64 abuts stop tabs 66 when support wafer 64 and interlocking plates 1010 are in an assembled configuration. Stop tabs 66 may be integrally formed with first plates 1024. Second plates 1026 are similar to second plates 26 described above. As can be seen in FIG. 18, the interlocking of first plates 1024 and second plates 1026 is similar to the interlocking of first plates 24 and second plates 26 as described above.

Figure 14A:
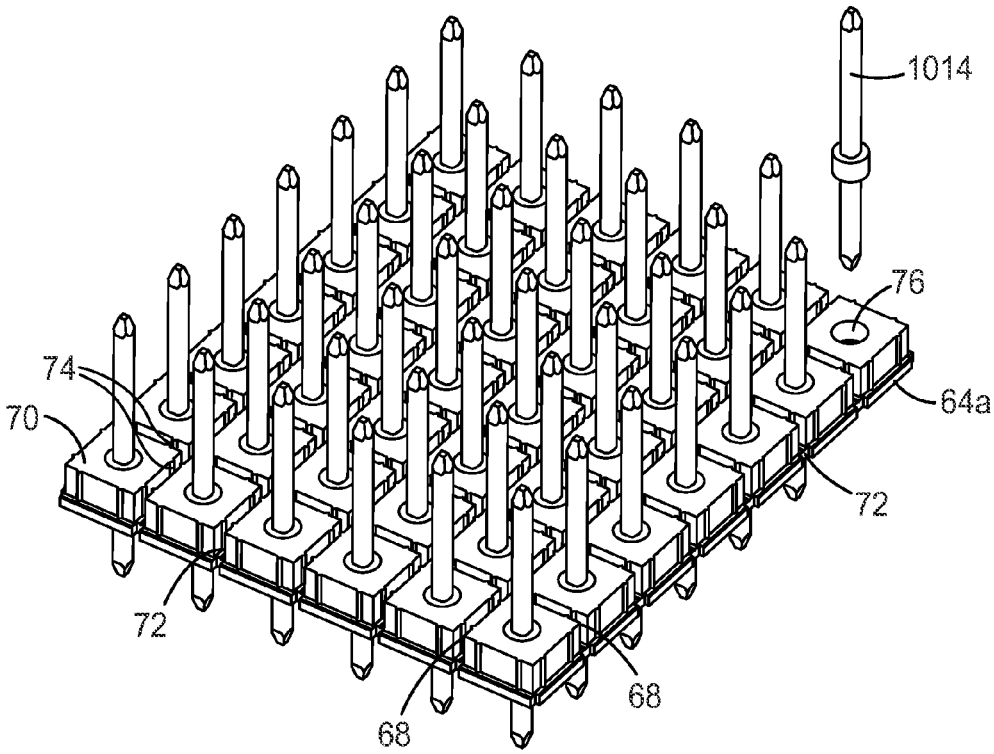
FIG. 14*a* is a partially exploded perspective view of a multi-cavity support wafer and electrical contacts of the electrical connector of FIG. 12.

Referring to FIG. 14*a*, in one embodiment, support wafer 64 includes a single multi-support wafer 64*a*. Multi-cavity support wafer 64*a* includes a plurality of plate-receiving channels 68 configured to receive interlocking plates 1010. Channels 68 define a plurality of single-cavity wafer portions 70 connected by frangible wafer sections 72. Each wafer portion 70 includes a plurality of retention elements 74 in the form of vertically extending ribs shaped to frictionally mutually retain at least a portion of multi-cavity support wafer 64*a* and interlocking plates 1010. In other embodiments, other forms of suitable retention elements may be used, such as, e.g., bumps, dimples, tabs, and latches, to name a few. To provide other modes of mutual retention of support wafer 64 and interlocking plates 1010, suitable retention elements may alternatively be included in interlocking plates 1010, or may be included in support wafer 64 with reciprocal elements included in interlocking plates 1010. Each wafer portion 70 is sized to be accepted by a corresponding cavity 1012 defined by interlocking plates 1010 and includes a contact aperture 76 shaped to accept an electrical contact 1014.

Figure 14B:
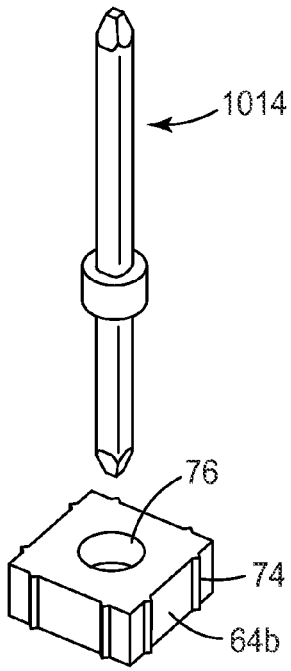
FIG. 14*b* is an exploded perspective view of an exemplary embodiment of a single-cavity support wafer and electrical contact that can be used in the electrical connector of FIG. 12.

In another embodiment, support wafer 64 includes a plurality of single-cavity support wafers 64*b*, one of which is illustrated in FIG. 14*b*. Each single-cavity support wafer 64*b* is sized to be accepted by a corresponding cavity 1012 defined by interlocking plates 1010 and includes a contact aperture 76 shaped to accept an electrical contact 1014. Similar to wafer portions 70 of multi-cavity support wafer 64*a*, each single-cavity support wafer 64*b* includes a plurality of retention elements 74 in the form of vertically extending ribs shaped to frictionally retain single-cavity support wafer 64*b* in interlocking plates 1010.

Figure 15:
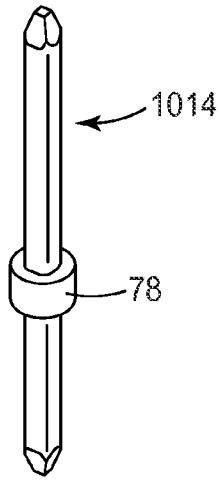
FIG. 15 is a perspective view of an electrical contact of the electrical connector of FIG. 12.

As illustrated in FIG. 15, electrical contact 1014 is similar to electrical contact 14 described above. Compared to electrical contact 14, electrical contact 1014 additionally includes a retention portion 78. Retention portion 78 is shaped to retain electrical contact 1014 in contact aperture 76. When designing an electrical connector, one goal is to minimize the changes in impedance as the signal travels through the electrical connector. By minimizing the changes in impedance, distortion and attenuation of the signal are reduced, thereby improving the electrical connector's performance. Accordingly, retention portion 78 is also shaped to provide a characteristic impedance of electrical connector 1004 of a desired target value, such as, e.g., 50 ohms.

Figure 19:
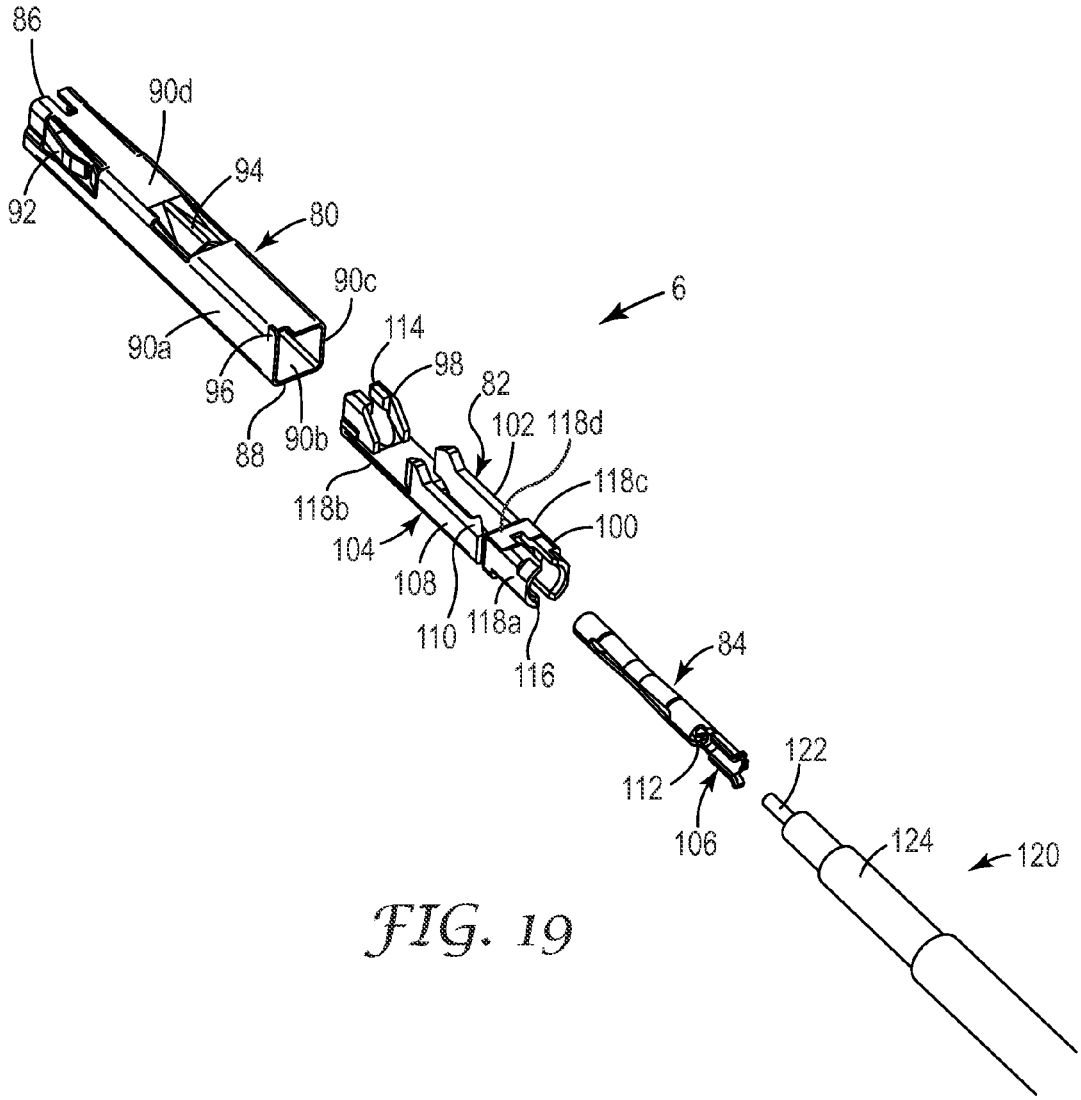
FIG. 19 is an exploded perspective view of a termination device of the electrical connector system of FIG. 1.

FIG. 19 illustrates an exemplary embodiment of a termination device 6 that can be used in electrical connector system 2 and in conjunction with electrical connector 4. FIG. 19 illustrates termination device 6 used with an electrical cable 120. Termination device 6 includes a longitudinal electrically conductive outer shield element 80, an insulator 82, and a single socket contact 84. Insulator 82 electrically isolates socket contact 84 from shield element 80. Shield element 80 has a front end 86, a back end 88, and side surfaces 90*a*-90*d* (collectively referred to herein as "sides 90") defining a non-circular transverse cross-section. Although the illustrated embodiment includes four sides 90 defining a substantially square transverse cross-section, shield element 80 may have other numbers of sides defining other generally rectangular or non-circular transverse cross-sections. In other embodiments, shield element 80 may have a generally curvilinear (such as, e.g., a circular) transverse cross-section. As illustrated, shield element 80 includes laterally protruding resilient ground contact elements 92 disposed on opposed side surfaces 90*a* and 90*c*. In other embodiments, shield element 80 includes only a single ground contact element 92. In other embodiments, one or more ground contact elements 92 may additionally, or alternatively, be included in interlocking plates 10, extending inwardly into each cavity 12. Ground contact elements 92 are configured to establish a ground connection between adjacent shield elements 80, either directly or via interlocking plates 10 of electrical connector 4 when electrical connector 4 and the plurality of termination devices 6 are in a mated configuration. A latch member 94 extends from at least one of sides 90. Latch member 94 is configured to retain termination device 6 in interlocking plates 10 of electrical connector 4 or an insulative carrier 128 (described below) configured to receive, secure, and manage a plurality of termination devices. In one embodiment, latch member 94 is designed to yield (i.e., deform) at a lower force than required to break the attached electrical cable 120, so that a termination device 6 can be pulled out of interlocking plates 10 for the purpose of replacing or repairing an individual termination device and cable assembly. In the illustrated embodiment of FIG. 19, latch member 94 is shown on a different side 90*d* as one of ground contact elements 92. However, in other embodiments, latch member 94 may additionally, or alternatively, be positioned on a side 90 of the shield element 80 that includes a ground contact element 92. Shield element 80 may further include a keying member, in the form of tab 96, laterally extending from back end 88 of shield element 80. Tab 96 is configured to ensure that termination device 6 is inserted into interlocking plates 10 of electrical connector 4 in the correct predetermined orientation. If termination device 6 is not properly oriented within interlocking plates 10, termination device 6 cannot be fully inserted. Although FIG. 19 shows that shield element 80 includes ground contact elements 92, it is within the scope of the present invention to use other contact element configurations, such as, e.g., Hertzian bumps.

Insulator 82 includes a first insulative member 98 disposed within shield element 80 adjacent front end 86, and a second insulative member 100 disposed within shield element 80 adjacent back end 88. First and second insulative members 98, 100 are configured to provide structural support to insulator 82. In this embodiment, a spacer bar 102 is provided that properly positions and spaces first and second insulative members 98, 100 with respect to each other. The first and second insulative members 98, 100 and spacer bar 102 are shaped to receive a socket contact 84 and are configured for slidable insertion into shield element 80, such that socket contact 84 lies substantially parallel to a longitudinal axis of shield element 80. The first and second insulative members 98, 100 and spacer bar 102 are configured to guide socket contact 84 during its insertion into insulator 82. In this configuration, termination device 6 can serve as a coaxial termination device, whereby socket contact 84 can be connected, e.g., to a single coaxial cable. A corresponding configuration of electrical connector 4 includes a single electrical contact 14 positioned within a single cavity 12, whereby socket contact 84 makes electrical contact with electrical contact 14 when electrical connector 4 and the plurality of termination devices 6 are in a mated configuration.

In another embodiment, one or more spacer bars 102 are shaped to receive two socket contacts 84 and are configured for slidable insertion into shield element 80, such that two socket contacts 84 lie substantially parallel to a longitudinal axis of shield element 80. One or more spacer bars 102 are configured to guide two socket contacts 84 during their insertion into insulator 82. In this configuration, termination device 6 can serve as a twinaxial termination device, whereby two socket contacts 84 can be connected, e.g., to a single twinaxial cable. A corresponding configuration of electrical connector 4 includes two electrical contacts 14 positioned within a single cavity 12, whereby each socket contact 84 makes electrical contact with corresponding electrical contact 14.

Insulator 82 further includes a first keying element 104 configured to orient and retain socket contact 84 in insulator 82. In one aspect, retaining socket contact 84 in insulator 82 prevents substantial movement of socket contact 84 in a direction substantially parallel to a longitudinal axis of socket contact 84. In one embodiment, socket contact 84 includes a second keying element 106 configured to engage with first keying element 104 when socket contact 84 and insulator 82 are in a correctly assembled configuration. First keying element 104 may be configured to prevent socket contact 84 from rotating in insulator 82 when socket contact 84 and insulator 82 are in a correctly assembled configuration.

In a preferred embodiment, spacer bar 102 and first keying element 104 are shaped and positioned relative to one or more socket contacts 84 and shield element 80 such that air is the major dielectric material surrounding one or more socket contacts 84, so as to lower the effective dielectric constant of termination device 6 and thereby lower the characteristic impedance of the termination device and cable assembly closer to the desired target value, such as, for example, 50 ohms.

In the embodiment illustrated in FIG. 19, first keying element 104 extends from first insulative member 98 and includes a resilient beam 108, and a male key portion 110 positioned at an end of resilient beam 108. Male key portion 110 engages with a female key portion 112 of second keying element 106 of socket contact 84 to properly position, orient and retain socket contact 84 in insulator 82. As socket contact 84 is inserted into insulator 82, first keying element 104 with resilient beam 108 and male key portion 110 deflects outwardly (away from socket contact 84) until engaging with female key portion 112. Beneficially, if socket contact 84 is incorrectly oriented or improperly assembled into insulator 82 (i.e., such that male key portion 110 is not aligned or engaged with female key portion 112, the presence of male key portion 110 will cause first keying element 104 to remain deflected outwardly such that insulator 82 will not fit in shield element 80, thereby preventing the installation and use of an improperly assembled termination device 6. Although in the embodiment of FIG. 19 first keying element 104 includes male key portion 110 and second keying element 106 includes female key portion 112 configured to receive male key portion 110, in other embodiments, the proper positioning, orienting, and retaining, as well as preventing rotation of socket contact 84, may be accomplished by alternative embodiments of first keying element 104 and second keying element 106. For example, second keying element 106 may include a male key portion and first keying element 104 may include a female key portion configured to receive the male key portion. In another example, first keying element 104 and second keying element 106 may include reciprocal key portions that, for example, include both male and female features. In alternative embodiments, insulator 82 may include two or more first keying elements 104 configured to orient and retain one or more socket contacts 84 in insulator 82. In other embodiments, first keying element 104 of insulator 82 may include a resilient beam 108 that spans between first insulative member 98 and second insulative member 100 of insulator 82.

Still referring to FIG. 19, insulator 82 has a front end 114, a back end 116, and outer surfaces 118*a*-118*d* (collectively referred to herein as "outer surface 118") defining a non-circular shape. Although the illustrated embodiment includes an outer surface 118 defining a substantially square shape, insulator 82 may have an outer surface 118 defining other suitable shapes, including generally rectangular, non-circular, or curvilinear (such as, e.g., circular) shapes.

Insulator 82 can be formed of any suitable material, such as, e.g., a polymeric material, by any suitable method, such as, e.g., injection molding, machining, or the like.

In one embodiment, insulator 82 and one or more first keying elements 104 may be monolithic. For example, insulator 82 and first keying elements 104 may be injection molded as a monolithic structure. In another embodiment, insulator 82 and one or more first keying elements 104 may comprise separate elements, assembled by any suitable method or structure, including but not limited to snap fit, friction fit, press fit, mechanical clamping, and adhesive. For example, insulator 82 may be injection molded and one or more first keying elements 104 may be machined and assembled to insulator 82 by press fit.

In one embodiment, termination device 6 is configured for termination of an electrical cable 120, such that a conductor 122 of electrical cable 120 is attached to socket contact 84 and ground shield 124 of electrical cable 120 is attached to shield element 80 of termination device 6 using conventional means, such as soldering. The type of electrical cable used in an aspect of the present invention can be a single wire cable (e.g., single coaxial or single twinaxial) or a multiple wire cable (e.g., multiple coaxial, multiple twinaxial, or twisted pair). In one embodiment, prior to attaching one or more socket contacts 84 to one or more conductors 122 of electrical cable 120, ground shield 124 is stiffened by a solder dip process. After one or more socket contacts 84 are attached to one or more conductors 122, the one or more socket contacts 84 are slidably inserted into insulator 82. The prepared end of electrical cable 120 and insulator 82 are configured such that the stiffened ground shield 124 bears against back end 116 of insulator 82 prior to one or more socket contacts 84 being fully seated against front end 114 of insulator 82. Thus, when insulator 82 (having one or more socket contacts 84 therein) is next slidably inserted into shield element 80, the stiffened ground shield 124 acts to push insulator 82 into shield element 80, and one or more socket contacts 84 are prevented from pushing against insulator 82 in the insertion direction. In this manner, one or more socket contacts 84 are prevented from being pushed back into electrical cable 120 by reaction to force applied during insertion of insulator 82 into shield element 80, which may prevent proper connection of one or more socket contacts 84 with electrical connector 4. In one embodiment, conductor 122 of electrical cable 120, once attached to socket contact 84, provides additional structure to female key portion 112 of second keying element 106 of socket contact 84 to help retain socket contact 84 in insulator 82.

In one embodiment, termination device 6 includes two socket contacts 84 and is configured for termination of an electrical cable 120 including two conductors 122. Each conductor 122 of electrical cable 120 is connected to a socket contact 84 of termination device 6, and ground shield 124 of electrical cable 120 is attached to shield element 80 of termination device 6 using conventional means, such as soldering. The type of electrical cable used in this embodiment can be a single twinaxial cable.

Figure 20:
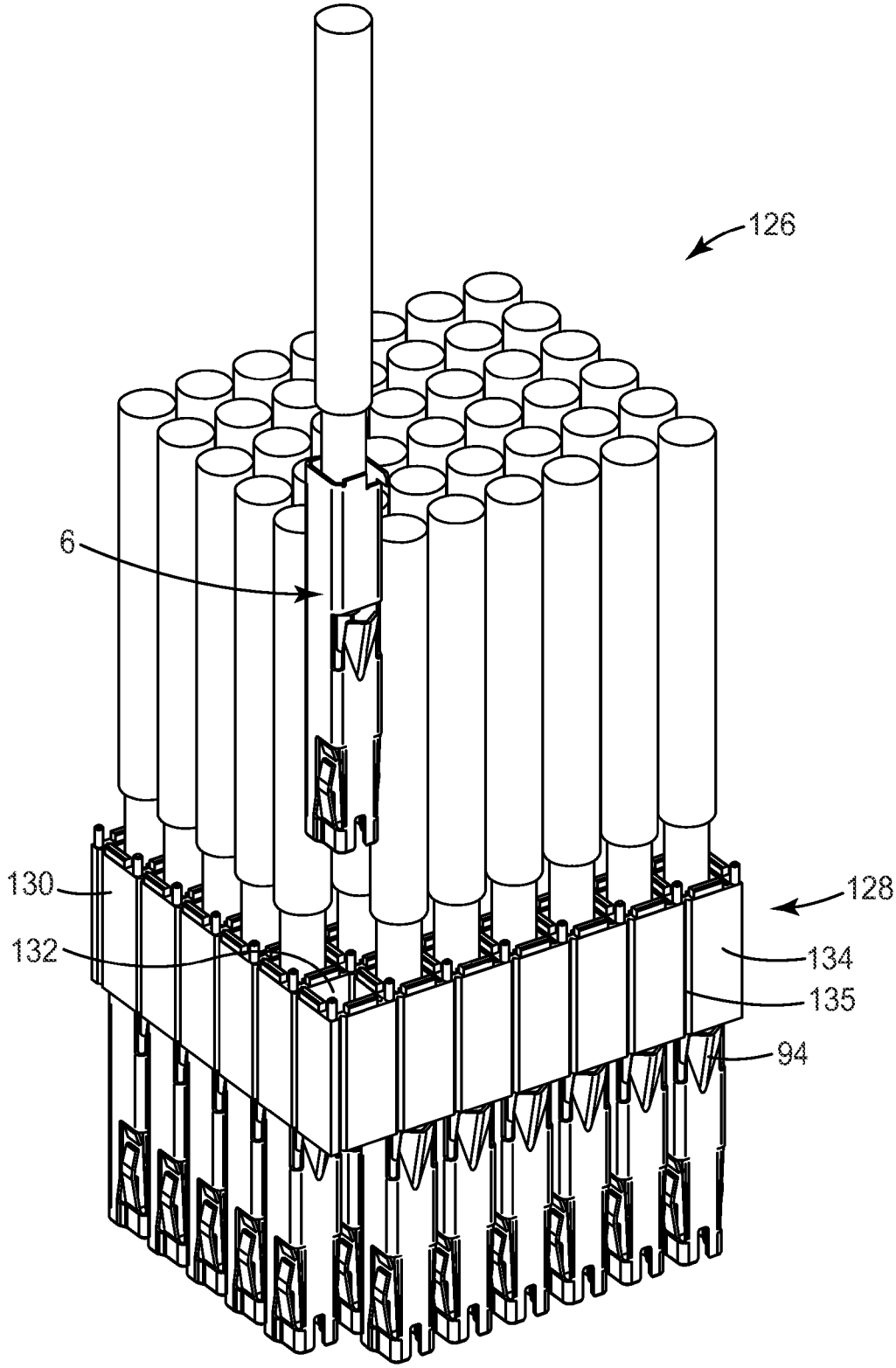
FIG. 20 is a partially exploded perspective view of an exemplary, embodiment of an electrical connector assembly according to an aspect of the present invention.
Figure 21:
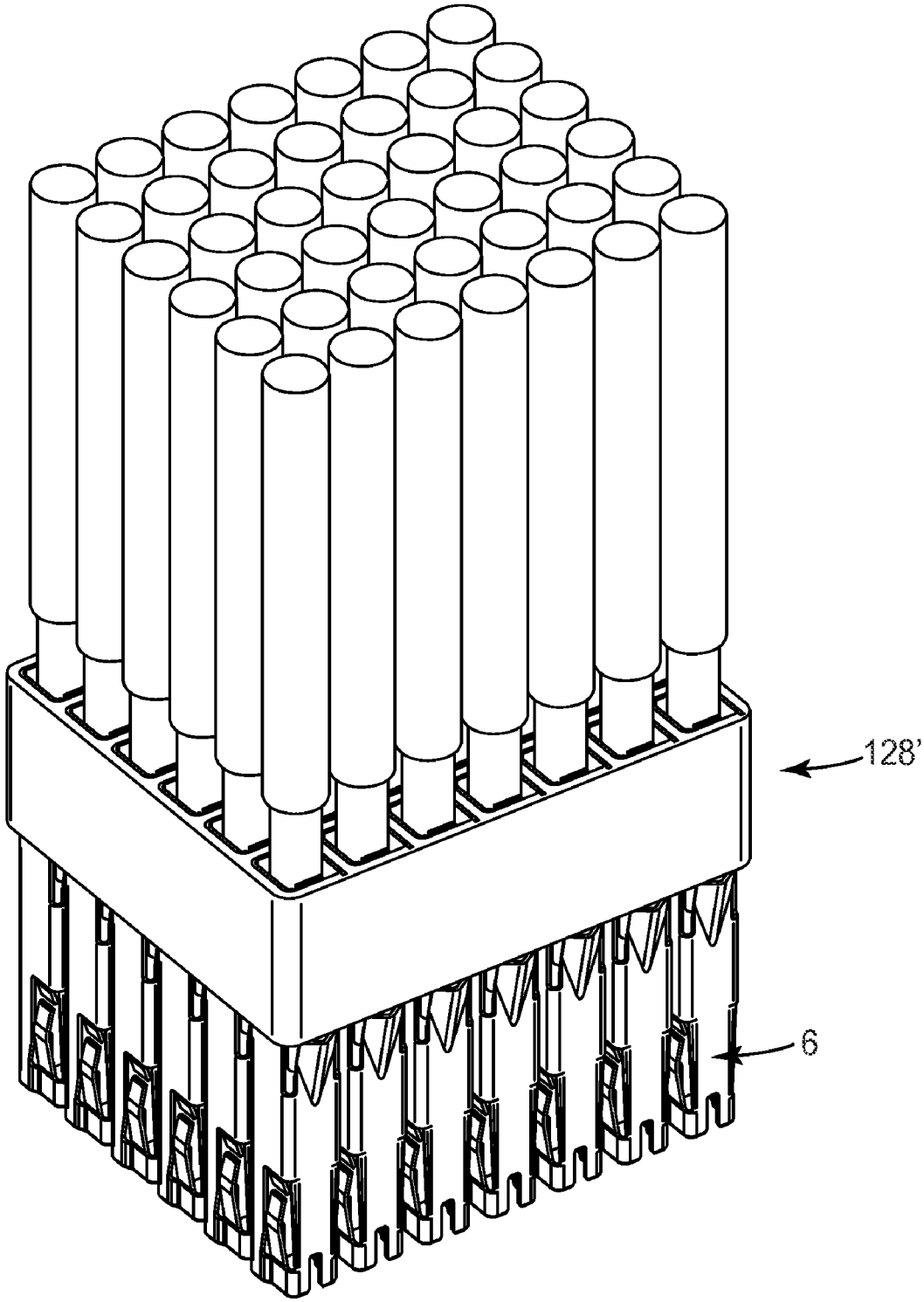
FIG. 21 is a perspective view of another exemplary embodiment of an electrical connector assembly according to an aspect of the present invention.

FIG. 20 illustrates an exemplary embodiment of an electrical connector assembly according to an aspect of the present invention. Electrical connector assembly 126 includes a plurality of termination devices 6 supported in an insulative carrier 128. Insulative carrier 128 is configured to receive, secure, and manage the plurality of termination devices 6. Insulative carrier 128 includes a plurality of carrier walls 130 defining an array of apertures 132. Apertures 132 are shaped to receive the plurality of termination devices 6. Carrier walls 130 optionally include a plurality of wall portions 134 connected by frangible wall sections 135 that enable customization (described below) of insulative carrier 128 and electrical connector assembly 126. Latch member 94 of termination device 6 is configured to retain termination device 6 in insulative carrier 128. In this embodiment, insulative carrier 128 is a pre-formed carrier formed by any suitable method, such as, e.g., injection molding. After forming the pre-formed carrier, termination devices 6 are inserted into the pre-formed carrier. In an alternative embodiment, as illustrated in FIG. 21, insulative carrier 128 is an overmolded carrier 128' formed around termination devices 6 by any suitable method, such as, e.g., insert-molding. An assembly of overmolded carrier 128' and termination devices 6 can be produced in a desired custom configuration such that, e.g., the assembly and a mating electrical connector have matching shapes. For example, the assembly may be produced to mate with electrical connector 2004 (described below). Electrical connector assembly 126 may be configured to mate with electrical connector 4 or electrical connector 1004 described above.

Figure 22:
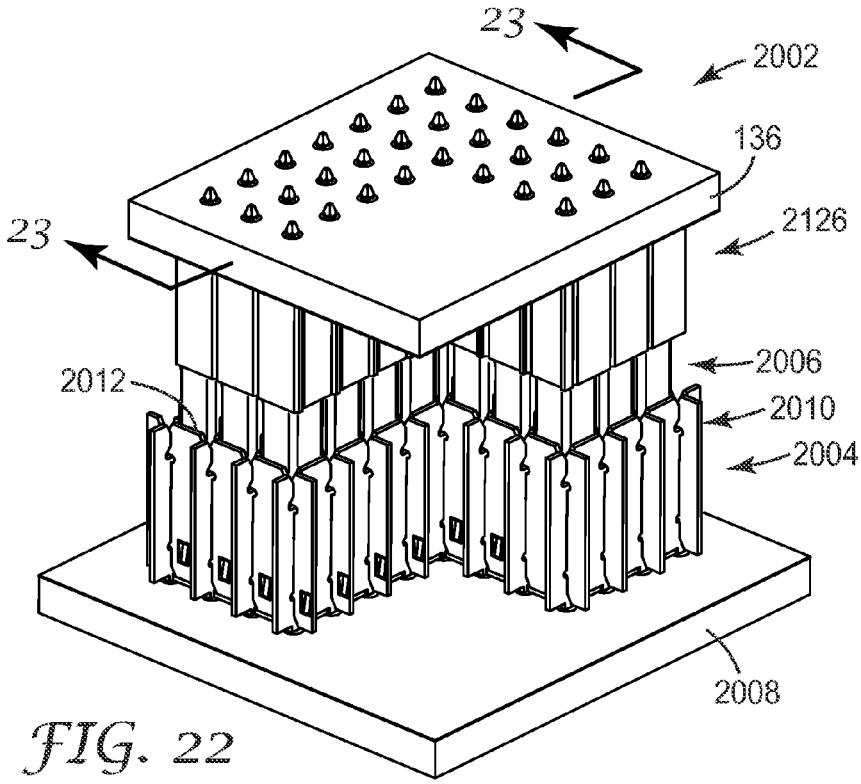
FIG. 22 is a perspective view of another exemplary embodiment of an electrical connector system according to an aspect of the present invention.
Figure 23:
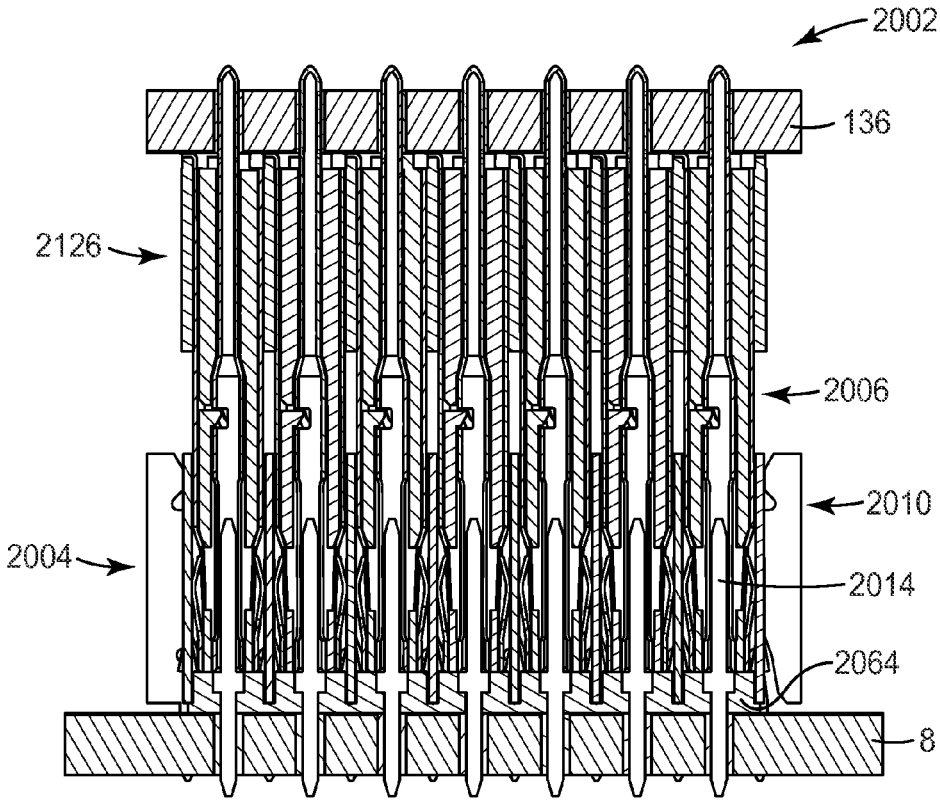
FIG. 23 is a front cross-sectional view of the electrical connector system of FIG. 22.

FIGS. 22-23 illustrate another exemplary embodiment of an electrical connector system according to an aspect of the present invention. Electrical connector system 2002 includes an electrical connector 2004 and an electrical connector assembly 2126 configured to mate with electrical connector 2004. Electrical connector 2004 may be connected to a circuit substrate, such as, e.g., printed circuit board 2008, and electrical connector assembly 2126 may be connected to a circuit substrate, such as, e.g., printed circuit board 136. Electrical connector 2004 is similar to electrical connector 1004 but is customized (described below) to provide a desired, in this exemplary embodiment L-shaped, configuration. Electrical connector 2004 includes an insulative support wafer 2064 and a plurality of interlocking plates 2010 defining a plurality of cavities 2012. Each cavity 2012 is sized for accepting a termination device 2006. Electrical connector 2004 further includes a plurality of electrical contacts 2014. Each electrical contact 2014 is positioned within a cavity 2012 supported by support wafer 2064, electrically isolated from interlocking plates 2010, and configured to mate with a socket contact of a termination device 2006 (described below).

Figure 24:
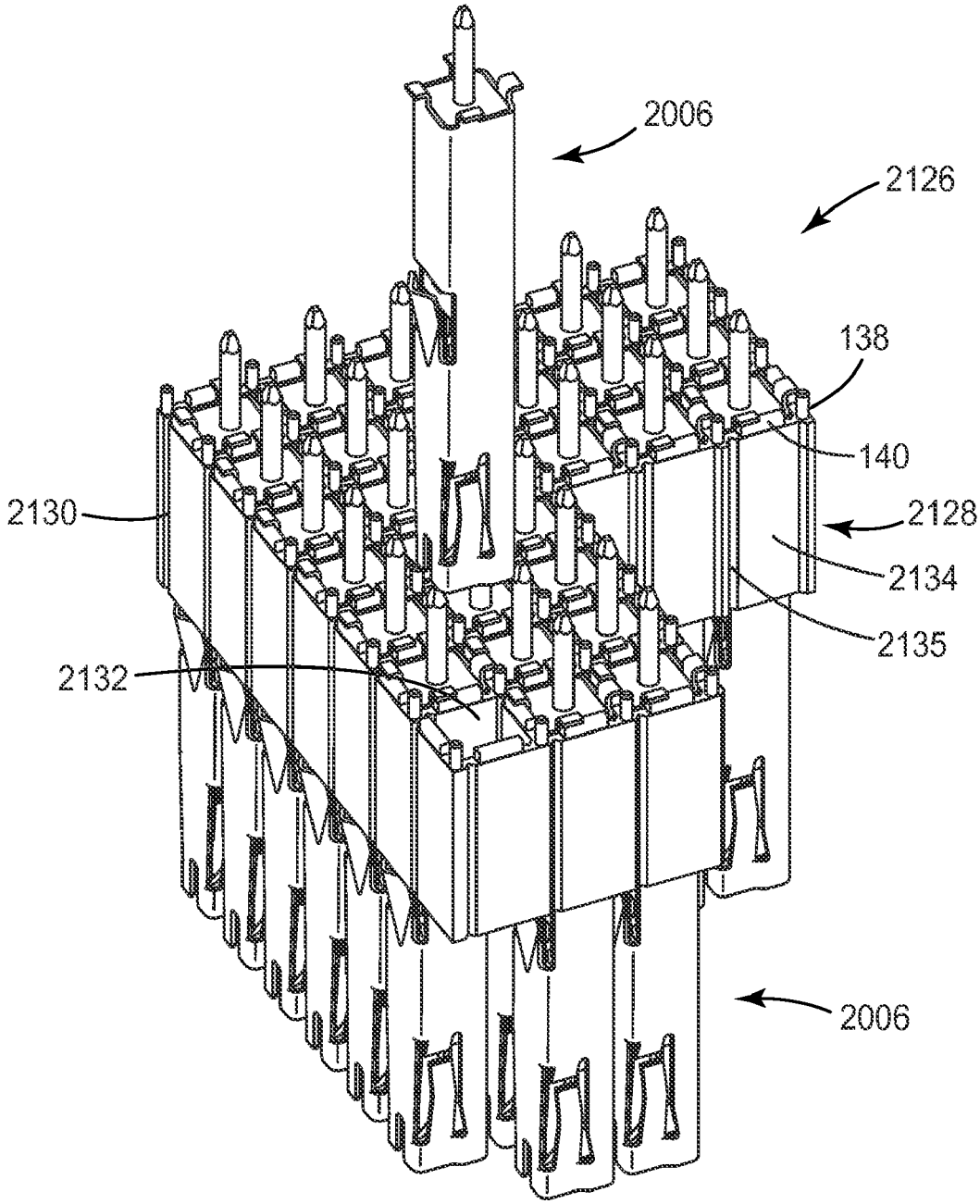
FIG. 24 is a partially exploded perspective view of the electrical connector assembly of the electrical connector system of FIG. 22.

Referring to FIG. 24, electrical connector assembly 2126 includes a plurality of termination devices 2006 supported in an insulative carrier 2128. Insulative carrier 2128 is similar to insulative carrier 128 of electrical connector assembly 126 but is customized (described below) to provide a desired, in this exemplary embodiment L-shaped, configuration. Insulative carrier 2128 is configured to receive, secure, and manage the plurality of termination devices 2006. Insulative carrier 2128 includes a plurality of carrier walls 2130 defining an array of apertures 2132. Apertures 2132 are shaped to receive the plurality of termination devices 2006. Carrier walls 2130 optionally include a plurality of wall portions 2134 connected by frangible wall sections 2135 that enable customization (described below) of insulative carrier 2128 and electrical connector assembly 2126. Insulative carrier 2128 includes a plurality of alignment posts 138 and standoffs 140 extending from carrier walls 2130. Alignment posts 138 are shaped to fit in corresponding holes (not shown) in printed circuit board 136 to properly position and align electrical connector assembly 2126 with respect to printed circuit board 136. Standoffs 140 are shaped to provide a clearance distance between termination devices 2006 and printed circuit board 136, e.g., to allow solder flux gases and heat to escape during the process of assembling electrical connector assembly 2126 to printed circuit board 136. Alignment posts 138 and standoffs 140 may be integrally formed with insulative carrier 2128. Insulative carrier 2128 may be a pre-formed carrier or an overmolded carrier as described above with respect to insulative carrier 128. Electrical connector assembly 2126 may be configured to mate with electrical connector 4 or electrical connector 1004 described above.

Figure 25:
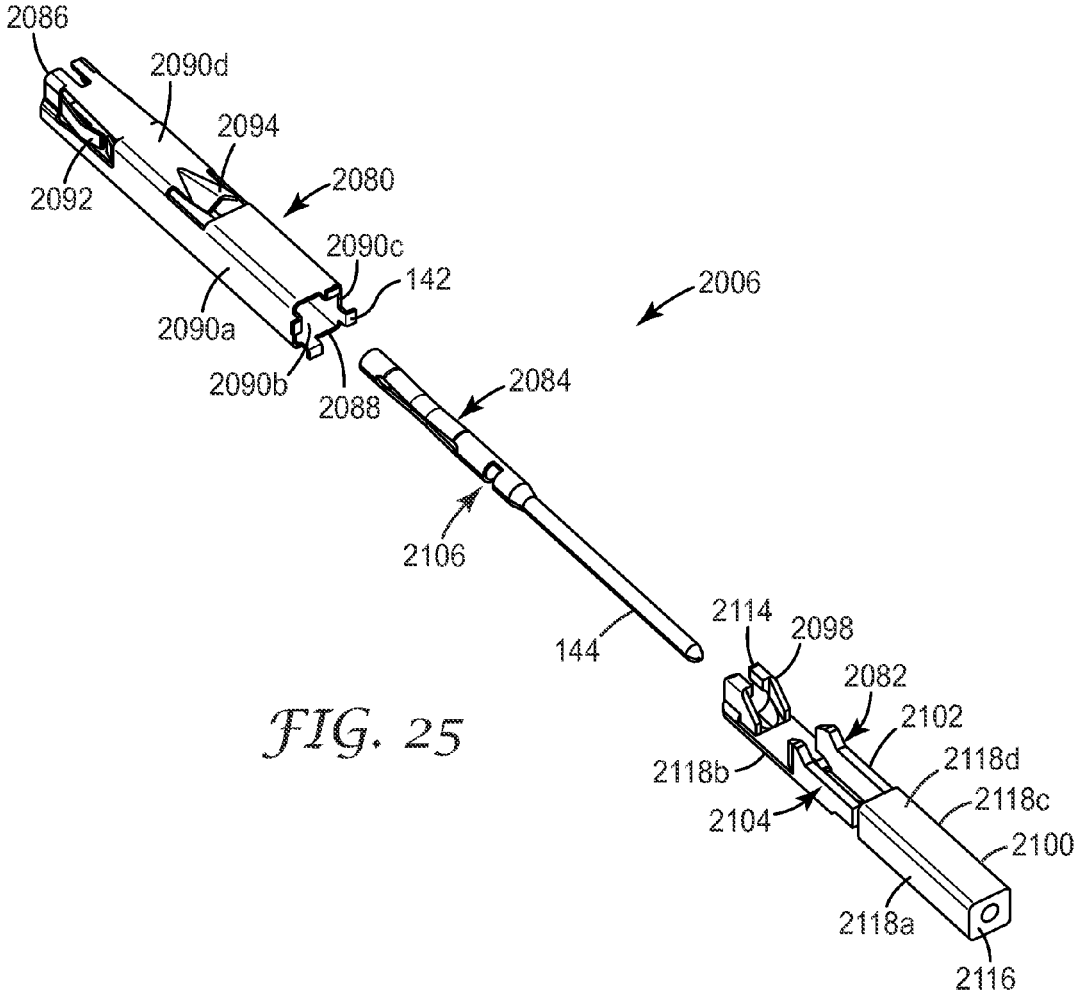
FIG. 25 is an exploded perspective view of a termination device of the electrical connector assembly of FIG. 24.

FIG. 25 illustrates an exemplary embodiment of a termination device 2006 that can be used in electrical connector assembly 2126 and in conjunction with electrical connector 2004. Termination device 2006 is configured for mounting to a circuit substrate, such as, e.g., printed circuit board 136. Termination device 2006 includes a longitudinal electrically conductive outer shield element 2080, an insulator 2082, and a single socket contact 2084. Insulator 2082 electrically isolates socket contact 2084 from shield element 2080. Shield element 2080 has a front end 2086, a back end 2088, and side surfaces **2090*a*-2090*d* (collectively referred to herein as "sides 2090") defining a non-circular transverse cross-section. Although the illustrated embodiment includes four sides 2090 defining a substantially square transverse cross-section, shield element 2080 may have other numbers of sides defining other generally rectangular or non-circular transverse cross-sections. In other embodiments, shield element 2080 may have a generally curvilinear (such as, e.g., a circular) transverse cross-section. As illustrated, shield element 2080 includes laterally protruding resilient ground contact elements 2092 disposed on opposed side surfaces 2090*a* and 2090*c* that are similar to ground contact elements 92 described above. A latch member 2094 extends from at least one of sides 2090 and is similar to latch member 94 described above. Shield element 2080 further includes a plurality of termination legs 142 extending from back end 2088. In the illustrated embodiment, shield element 2080 includes four termination legs 142 disposed adjacent side surfaces 2090*a*-2090*d*, respectively, and extending from back end 2088 such as to interdigitate with termination legs 142 of a shield element 2080 of an adjacent termination device 2006 when electrical connector assembly 2126 is in an assembled configuration. This allows a close positioning of adjacent termination devices 2006. In other embodiments, termination legs 142 may extend from back end 2088 in any suitable arrangement and may have any suitable shape. Termination legs 142 may include one or both of surface-mount termination legs (as illustrated in FIG. 25) and through-hole termination legs suitable for the intended application. Termination legs 142 and latch member 2094 are configured to cooperatively retain termination device 2006 in insulative carrier 2128; termination legs 142 prevent termination device 2006 from falling through cavities 2012 and latch member 2094 prevents termination device 2006** from backing out.

Insulator 2082 includes a first insulative member 2098 disposed within shield element 2080 adjacent front end 2086, and a second insulative member 2100 disposed within shield element 2080 adjacent back end 2088. First and second insulative members 2098, 2100 are configured to provide structural support to insulator 2082. In this embodiment, a spacer bar 2102 is provided that properly positions and spaces first and second insulative members 2098, 2100 with respect to each other. The first and second insulative members 2098, 2100 and spacer bar 2102 are shaped to receive a socket contact 2084 and are configured for slidable insertion into shield element 2080, such that socket contact 2084 lies substantially parallel to a longitudinal axis of shield element 2080. The first and second insulative members 2098, 2100 and spacer bar 2102 are configured to guide socket contact 2084 during its insertion into insulator 2082. A corresponding configuration of electrical connector 2004 includes a single electrical contact 2014 positioned within a single cavity 2012, whereby socket contact 2084 makes electrical contact with electrical contact 2014 when electrical connector 2004 and the plurality of termination devices 2006 are in a mated configuration.

In another embodiment, one or more spacer bars 2102 are shaped to receive two socket contacts 2084 and are configured for slidable insertion into shield element 2080, such that two socket contacts 2084 lie substantially parallel to a longitudinal axis of shield element 2080. One or more spacer bars 2102 are configured to guide two socket contacts 2084 during their insertion into insulator 2082. A corresponding configuration of electrical connector 2004 includes two electrical contacts 2014 positioned within a single cavity 2012, whereby each socket contact 2084 makes electrical contact with corresponding electrical contact 2014.

Insulator 2082 further includes a first keying element 2104 that is similar to first keying element 104 described above. In one embodiment, socket contact 2084 includes a second keying element 2106 configured to engage with first keying element 2104 when socket contact 2084 and insulator 2082 are in a correctly assembled configuration.

Insulator 2082 has a front end 2114, a back end 2116, and outer surfaces 2118*a*-2118*d* (collectively referred to herein as "outer surface 2118") defining a non-circular shape. Although the illustrated embodiment includes an outer surface 2118 defining a substantially square shape, insulator 2082 may have an outer surface 2118 defining other suitable shapes, including generally rectangular, non-circular, or curvilinear (such as, e.g., circular) shapes.

Insulator 2082 can be formed of any suitable material, such as, e.g., a polymeric material, by any suitable method, such as, e.g., injection molding, machining, or the like.

Socket contact 2084 is configured for making electrical connections through front end 2086 and back end 2088 of shield element 2080. Socket contact 2084 includes a termination end 144 supported in second insulative member 2100 and extending beyond back end 2088 of shield element 2080 to enable termination of socket contact 2084 to a circuit substrate, such as e.g., printed circuit board 136. Termination end 144 may include one of a surface-mount termination end and a through-hole termination end (as illustrated in FIG. 25) suitable for the intended application.

An advantage of electrical connectors and electrical connector assemblies according to aspects of the present invention is that they can be customized to provide a desired configuration. Customization may be desired, e.g., to reduce the contact count to a desired number, or to clear or surround other components on a printed circuit board. The ability to clear or surround other components on a printed circuit board would provide a more efficient use of printed circuit board real estate and minimized circuit trace lengths between devices and the electrical connectors according to aspects of the present invention, which in turn would provide advantages with respect to electrical performance characteristics, such as, e.g., bandwidth and crosstalk, of the system. FIGS. 26*a*-35*b* illustrate various aspects of the customization of electrical connectors and electrical connector assemblies according to aspects of the present invention.

Figure 26A:
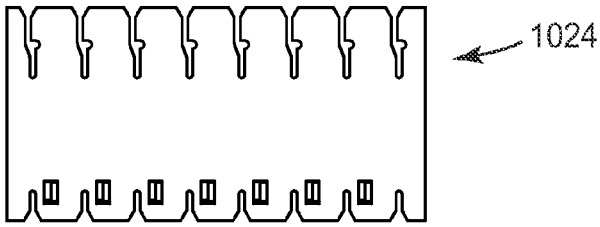
FIGS. 26*a*-26*b* are front views illustrating the customization of a first plate of the electrical connector of FIG. 12.
Figure 26B:
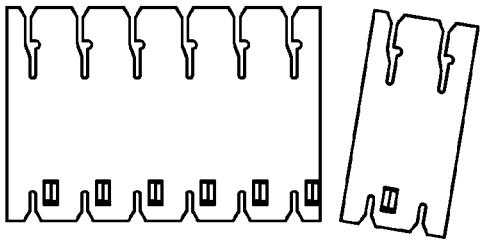
Figure 27A:
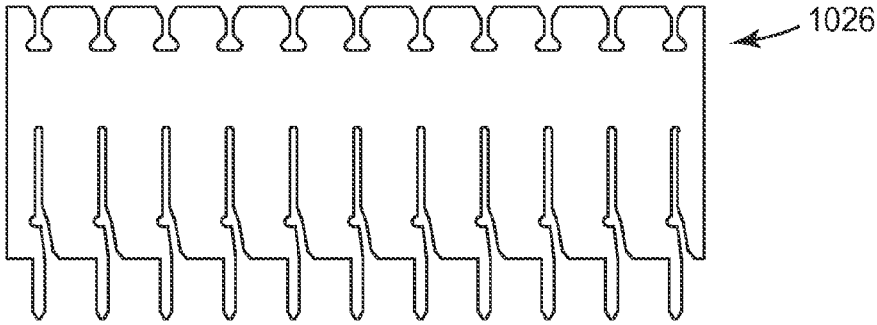
FIGS. 27*a*-27*b* are front views illustrating the customization of a second plate of the electrical connector of FIG. 12.
Figure 27B:
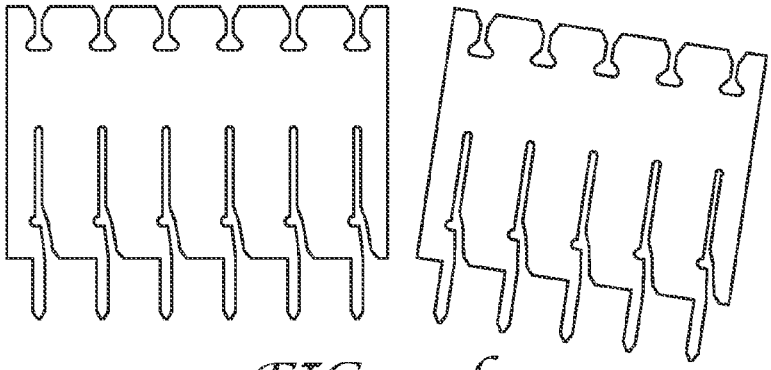

FIGS. 26*a*-30*d* illustrate various aspects of the customization of electrical connector 1004 illustrated in FIG. 12. Interlocking plates 1010 of electrical connector 1004 may be customized to provide a desired connector configuration. FIGS. 26*a*-26*b* illustrate the customization of a first plate 1024 of electrical connector 1004. First plate 1024 may be produced at a standardized length (FIG. 26*a*) and made shorter to a desired length (FIG. 26*b*) using any suitable method. For example, first plate 1024 may be cut by using a manual or automatic cutting tool. First plate 1024 may be cut at a desired random location or at a desired predetermined location, e.g., by including cutting location indicators in first plate 1024 that substantially correspond to cavities 1012. Alternatively, first plate 1024 may be broken at a desired predetermined location, e.g., by including score lines in first plate 1024 that substantially correspond to cavities 1012. FIGS. 27*a*-27*b* illustrate the customization of a second plate 1026 of electrical connector 1004. Second plate 1026 may be produced at a standardized length (FIG. 27*a*) and made shorter to a desired length (FIG. 27*b*) as described above with respect to first plate 1024.

Figure 28A:
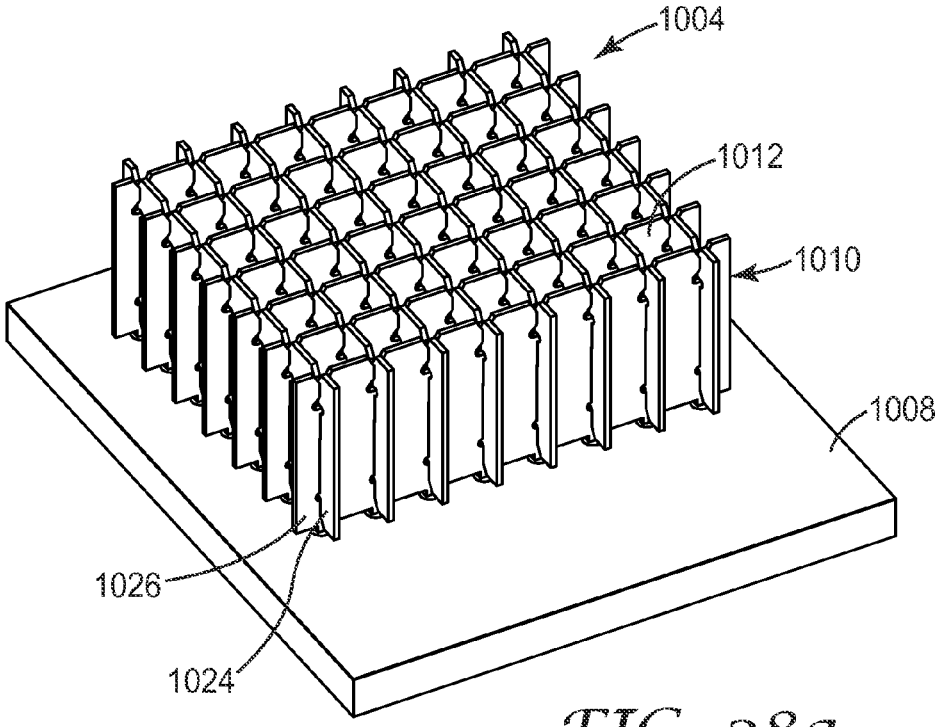
FIGS. 28*a*-28*c* are perspective views of the electrical connector of FIG. 12 in exemplary standard and customized configurations.
Figure 28B:
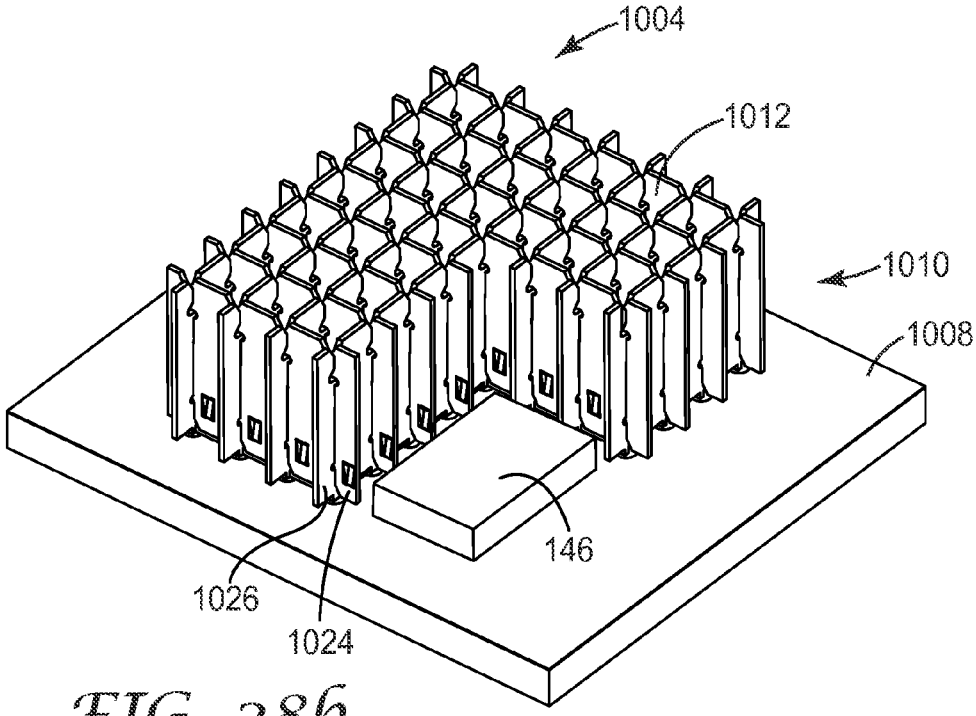
Figure 28C:
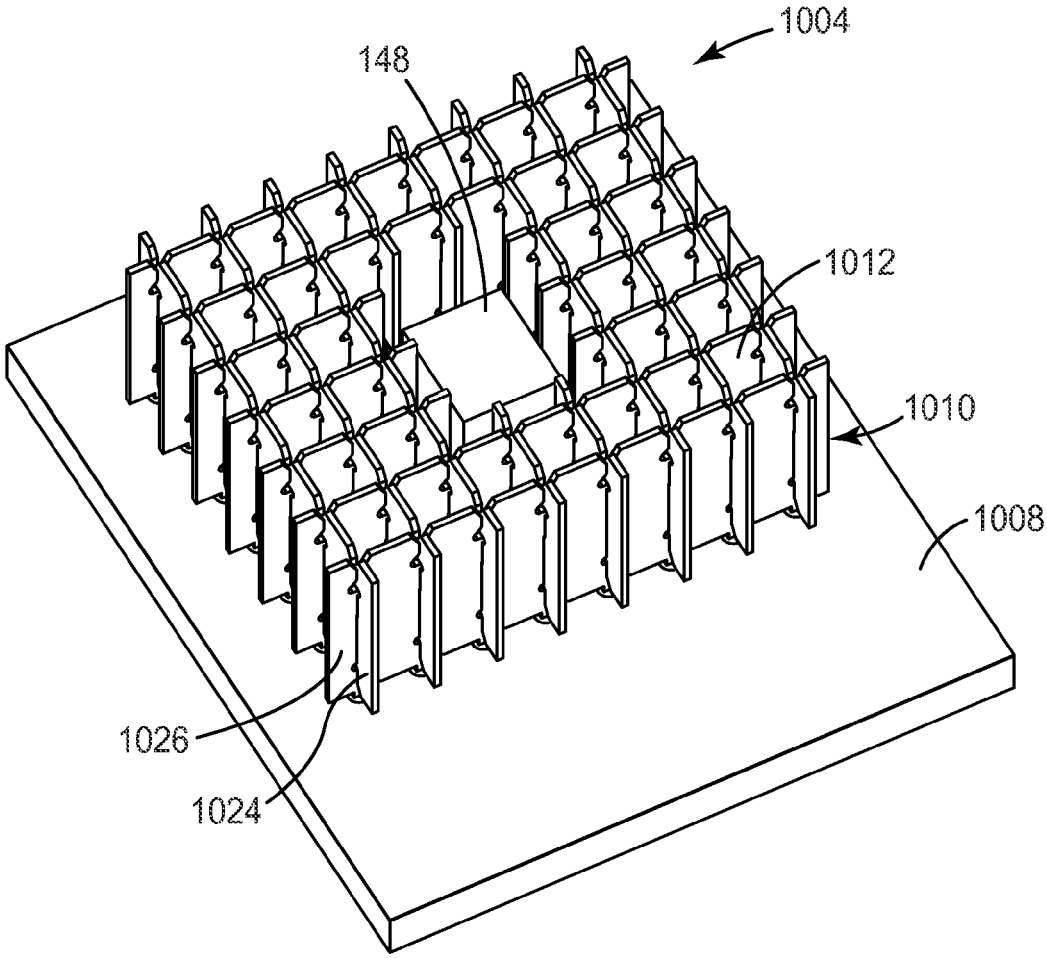
Figure 29B:
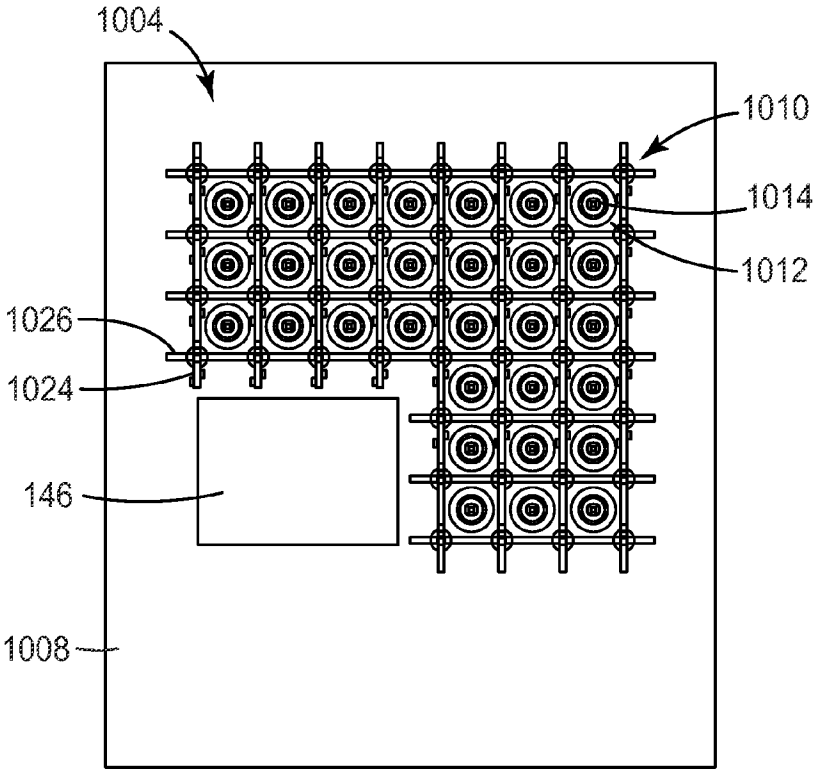
FIGS. 29*a*-29*c* are top views of the electrical connector of FIG. 12 in exemplary standard and customized configurations.
Figure 29A:
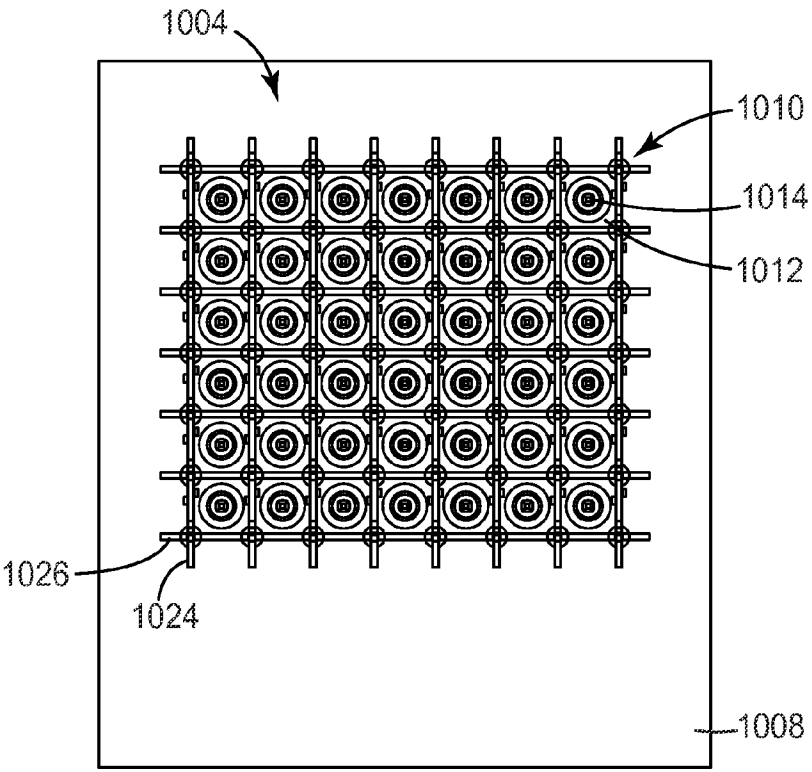
Figure 29C:
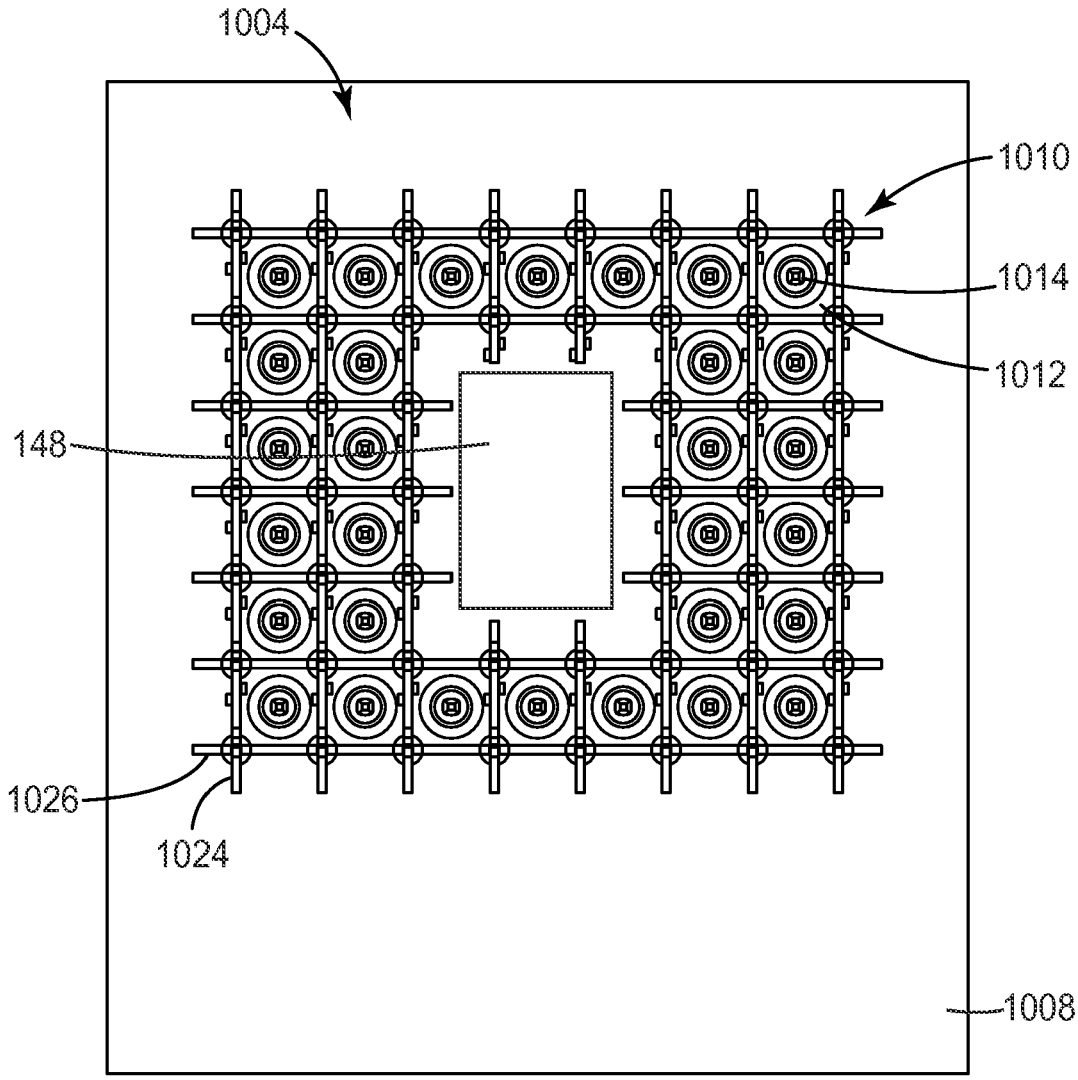

FIGS. 28*a*-28*c* and 29*a*-29*c* illustrate electrical connector 1004 in exemplary standard and customized configurations. FIGS. 28*a* and 29*a* illustrate electrical connector 1004 in an exemplary standard configuration, whereby interlocking plates 1010 define an array of 7×6 cavities 1012. As can be seen in FIG. 29*a*, an electrical contact 1014 is positioned within each cavity 1012. FIGS. 28*b* and 29*b* illustrate electrical connector 1004 in an exemplary customized configuration, whereby interlocking plates 1010 defining an array of 7×6 cavities 1012 are customized by removing an outer portion (defining an array of 4×3 cavities 1012) of interlocking plates 1010, resulting in an L-shaped configuration to clear an external component 146 on printed circuit board 1008. Removing this outer portion includes customizing four first plates 1024 and three second plates 1026 as described above. As can be seen in FIG. 29*b*, an electrical contact 1014 is positioned within each remaining cavity 1012. FIGS. 28*c* and 29*c* illustrate electrical connector 1004 in another exemplary customized configuration, whereby interlocking plates 1010 defining an array of 7×6 cavities 1012 are customized by removing an inner portion (defining an array of 3×4 cavities 1012) of interlocking plates 1010, resulting in an O-shaped configuration to surround an internal component 148 on printed circuit board 1008. Removing this inner portion includes customizing two first plates 1024 and three second plates 1026 as described above. As can be seen in FIG. 29*c*, an electrical contact 1014 is positioned within each remaining cavity 1012.

Figure 30B:
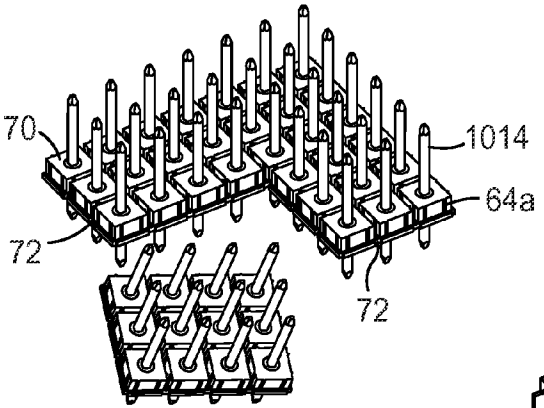
FIGS. 30*a*-30*d* are perspective views illustrating the customization of the electrical connector of FIG. 12.
Figure 30A:
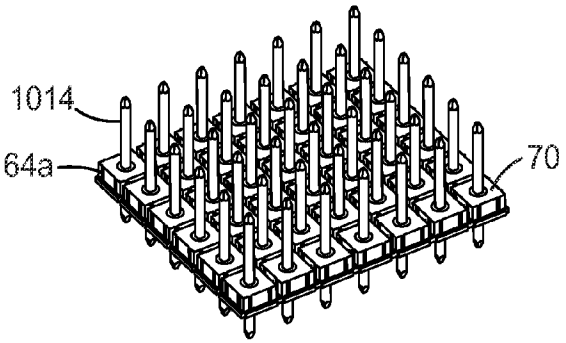
Figure 30C:
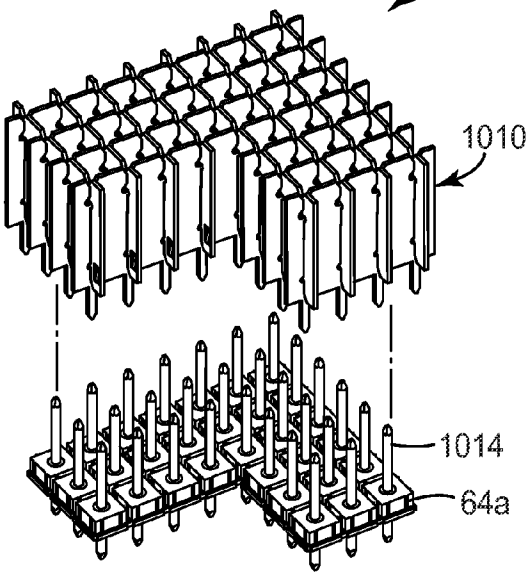
Figure 30D:
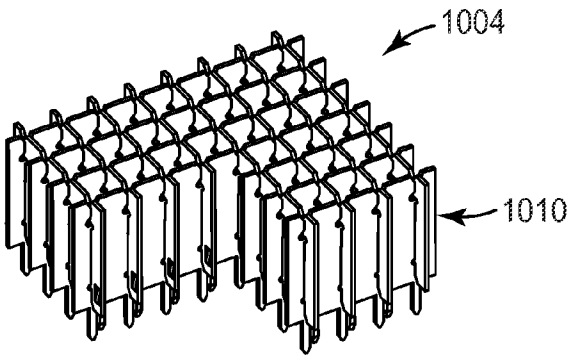

FIGS. 30*a*-30*d* illustrate exemplary steps in the customization of electrical connector 1004. Referring to FIG. 30*a*, an assembly of a multi-cavity support wafer 64*a* and a plurality of electrical contacts 1014 is provided in an exemplary standard configuration, whereby multi-cavity support wafer 64*a* defines an array of 7×6 wafer portions 70 and corresponding electrical contacts 1014. Referring to FIG. 30*b*, multi-cavity support wafer 64*a* is customized by removing an outer portion (defining an array of 4×3 wafer portions 70 and corresponding electrical contacts 1014), resulting in an L-shaped configuration. Removing this outer portion may be achieved by removing (e.g., breaking or shearing) selective wafer portions 70 from multi-cavity support wafer 64*a* at appropriate frangible wafer sections 72 using any suitable method including manual, semi-automatic, and automatic methods. Referring to FIGS. 30*c*-30*d*, interlocking plates 1010 are provided and customized as described above. The customization of multi-cavity support wafer 64*a* and interlocking plates 1010 is done such that multi-cavity support wafer 64*a* and interlocking plates 1010 have matching shapes. Customized multi-cavity support wafer 64*a* and customized interlocking plates 1010 are aligned (FIG. 30*c*) and assembled (FIG. 30*d*) as described above with respect to FIG. 14*a*. Alternatively, electrical connector 1004 may be customized by providing a plurality of assemblies of a single-cavity support wafer 64*b* (FIG. 14*b*) and an electrical contact 1014, providing and customizing interlocking plates 1010 as described above, and inserting an assembly of a single-cavity support wafer 64*b* and an electrical contact 1014 into each remaining cavity 1012 of customized interlocking plates 1010.

Figure 31B:
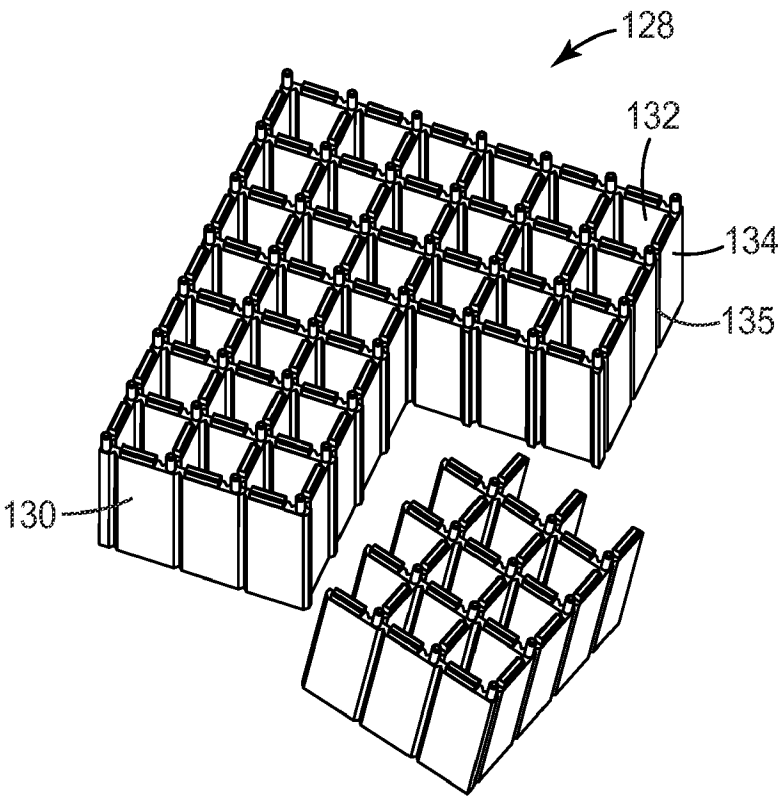
FIGS. 31*a*-31*b* are perspective views illustrating the customization of the carrier of the electrical connector assembly of FIG. 20.
Figure 31A:
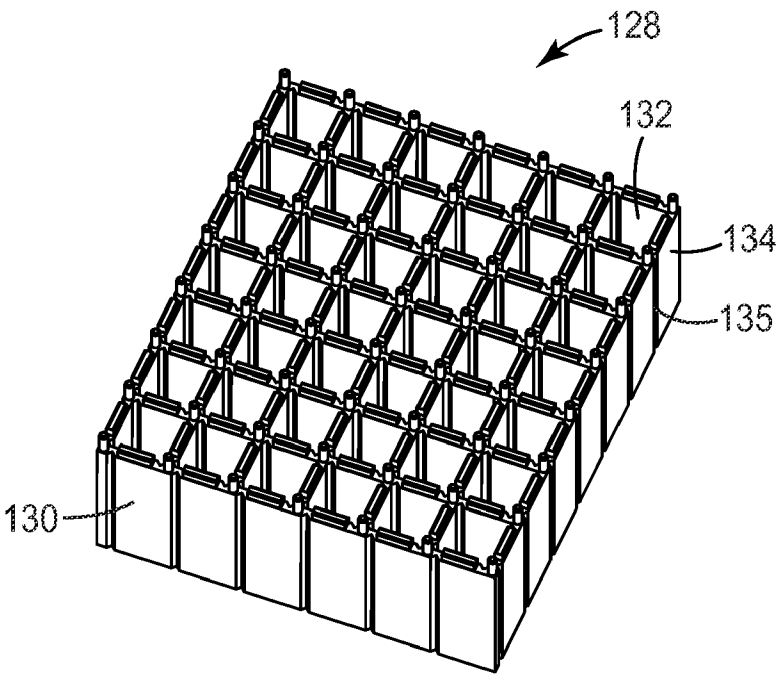

FIGS. 31*a*-35*b* illustrate various aspects of the customization of electrical connector assembly 126 illustrated in FIG. 20. Insulative carrier 128 of electrical connector assembly 126 may be customized to provide a desired connector configuration. FIGS. 31*a*-31*b* illustrate the customization of insulative carrier 128. Referring to FIG. 31*a*, an insulative carrier 128 is provided in an exemplary standard configuration, whereby insulative carrier 128 includes a plurality of carrier walls 130 defining an array of 7×6 apertures 132. Referring to FIG. 31*b*, insulative carrier 128 is customized by removing an outer portion (defining an array of 4×3 apertures 132), resulting in an L-shaped configuration. Removing this outer portion may be achieved by removing selective wall portions 134 (e.g., by breaking or shearing corresponding frangible wall section(s) 135) from carrier walls 130 using any suitable method including manual, semi-automatic, and automatic methods.

Figure 32:
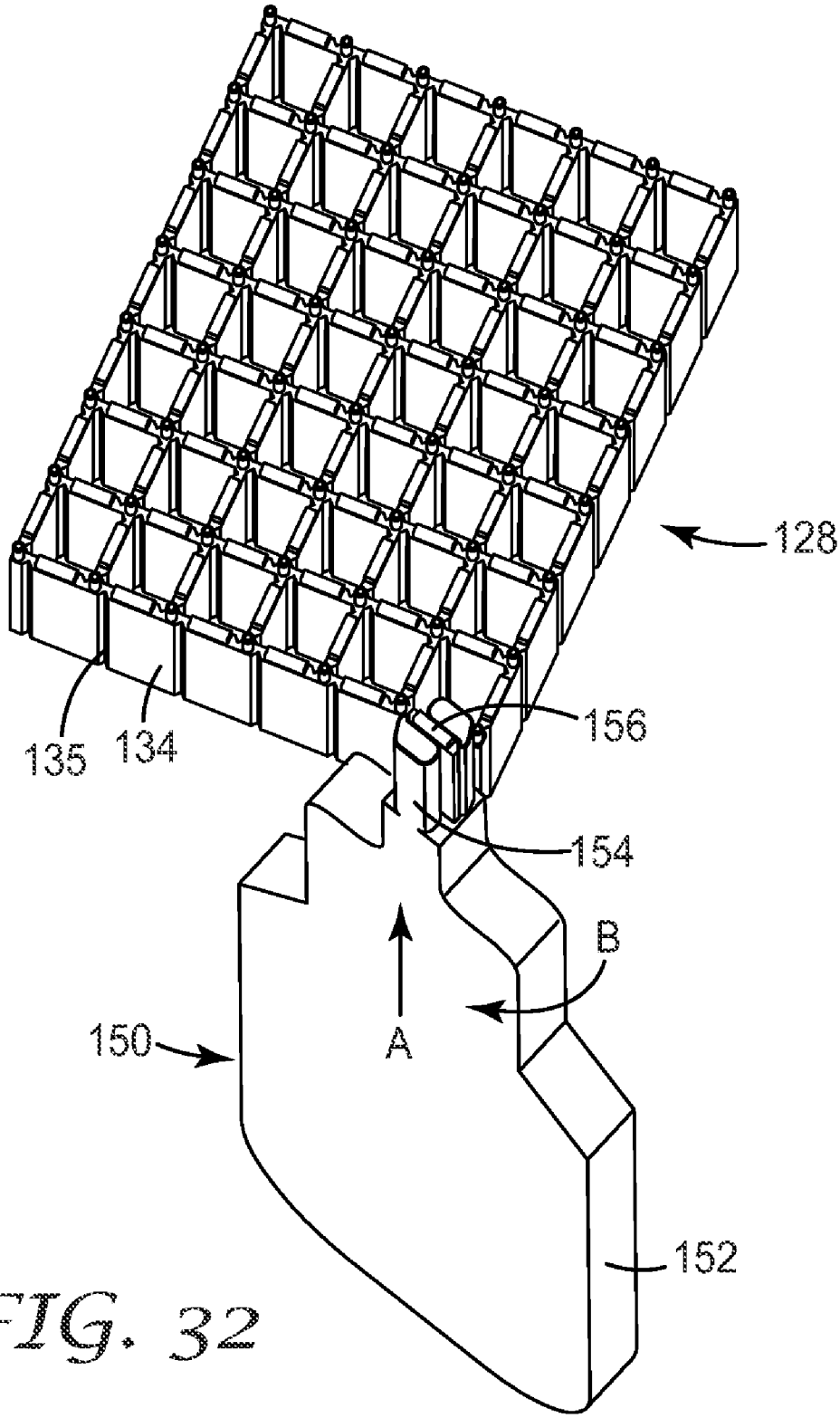
FIG. 32 is a perspective view illustrating the customization of the carrier of the electrical connector assembly of FIG. 20 using an exemplary embodiment of a tool suitable for use with an insulative carrier.
Figure 33B:
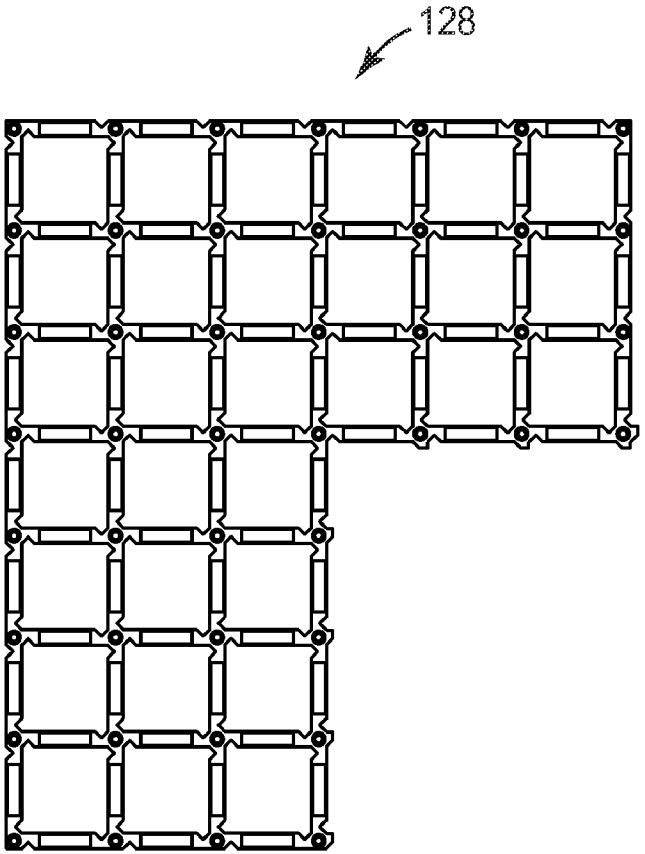
Figure 33A:
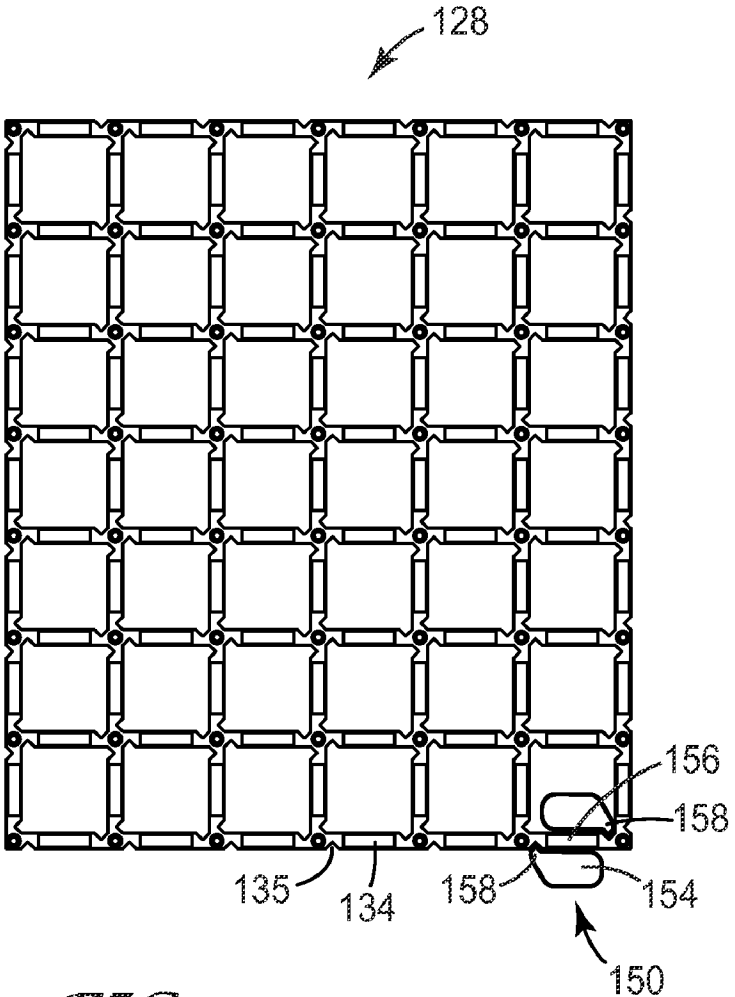

A tool may be provided to remove wall portions 134 from carrier walls 130 of insulative carrier 128. This tool may be a hand tool or may be part of a semi-automatic or automatic apparatus. FIGS. 32-33*b* illustrate the customization of insulative carrier 128 using an exemplary embodiment of a tool for use with an insulative carrier according to an aspect of the present invention. Tool 150 includes a body portion 152 and a head portion 154 extending from body portion 152. Head portion 154 is shaped for insertion into insulative carrier 128. Head portion 154 includes a channel 156 shaped to receive and remove a wall portion 134 from insulative carrier 128. To remove a wall portion 134, tool 150 is inserted into insulative carrier 128 in the direction indicated by arrow A (FIG. 32), such that head portion 154 straddles the wall portion 134 that is to be removed. Head portion 154 is guided into position by this wall portion 134. Optionally, opposing guide portions 158 may extend from head portion 154 into channel 156 to provide additional guidance at frangible wall sections 135. Tool 150 is then twisted in the direction indicated by arrow B (FIG. 32) to remove the wall portion 134.

Figure 34:
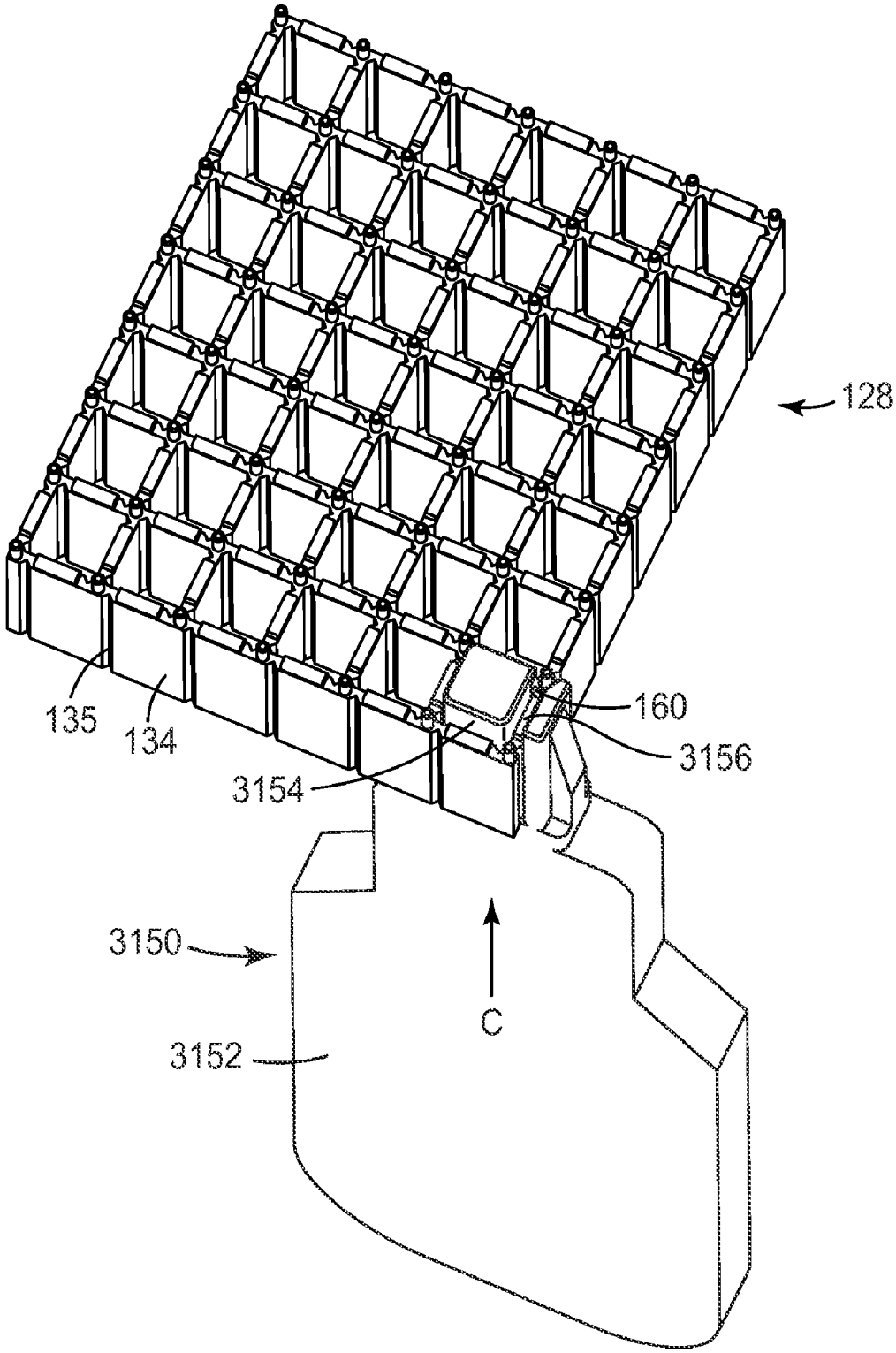
FIG. 34 is a perspective view illustrating the customization of the carrier of the electrical connector assembly of FIG. 20 using another exemplary embodiment of a tool suitable for use with an insulative carrier.
Figure 35B:
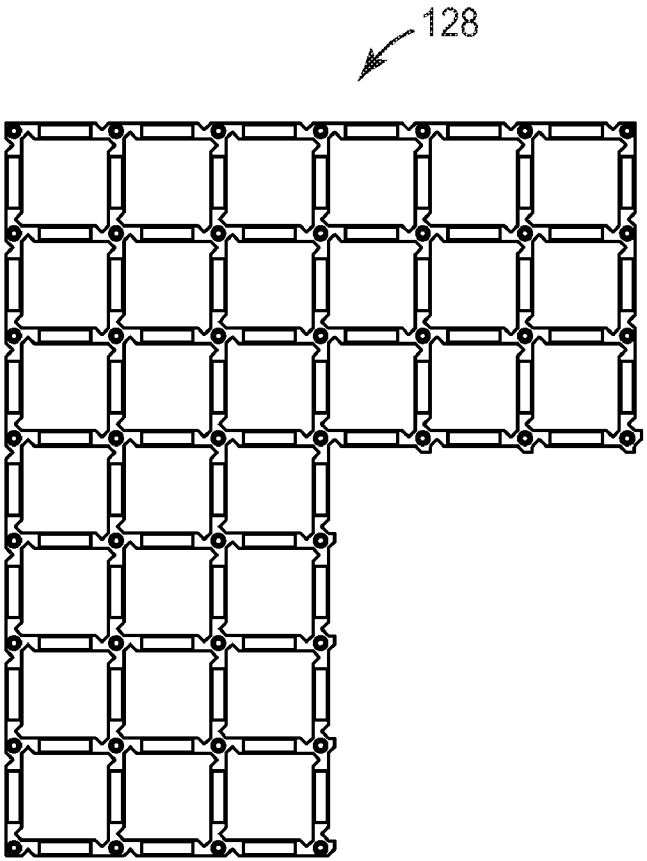
FIGS. 35*a*-35*b* are top views illustrating the customization of the carrier of the electrical connector assembly of FIG. 20 using the tool illustrated in FIG. 34.
Figure 35A:
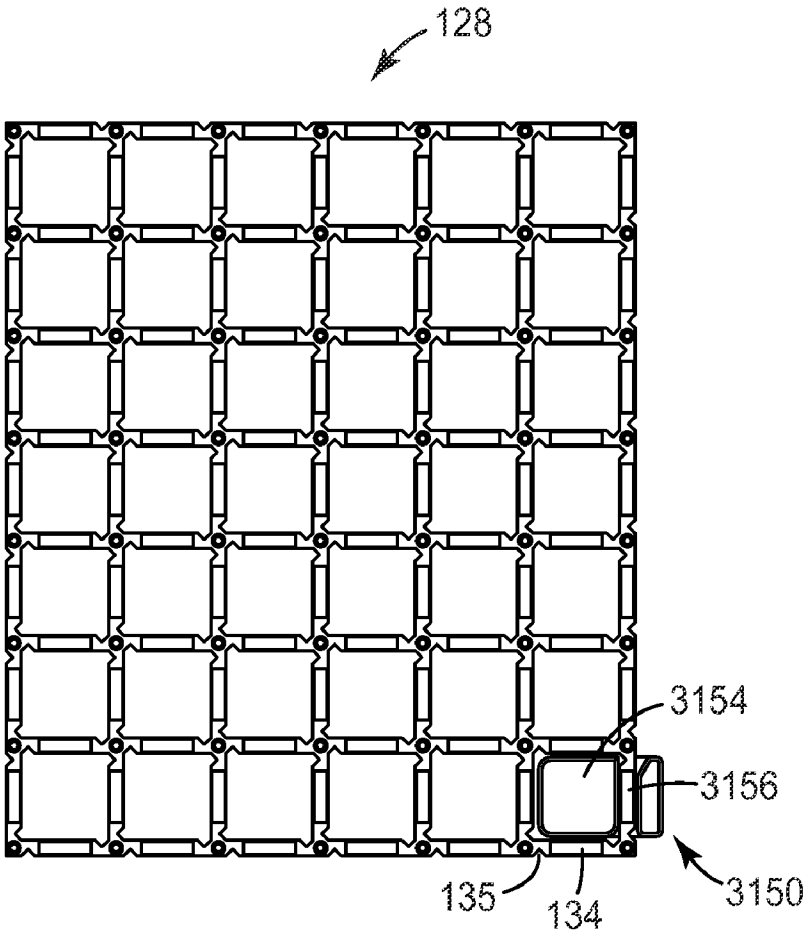

FIGS. 34-35*b* illustrate the customization of insulative carrier 128 using another exemplary embodiment of a tool for use with an insulative carrier according to an aspect of the present invention. Tool 3150 includes a body portion 3152 and a head portion 3154 extending from body portion 3152. Head portion 3154 is shaped for insertion into insulative carrier 128. Head portion 3154 includes a channel 3156 shaped to receive and remove a wall portion 134 from insulative carrier 128. To remove a wall portion 134, tool 3150 is inserted into insulative carrier 128 in the direction indicated by arrow C (FIG. 34), such that a wedge portion 160 extending from head portion 3154 into channel 3156 progressively applies force to a frangible wall section 135 connecting the wall portion 134 that is to be removed until the frangible wall section 135 fractures at this end.

In each of the embodiments and implementations described herein, the various components of the electrical connector system and elements thereof are formed of any suitable material. The materials are selected depending upon the intended application and may include both metals and non-metals (e.g., any one or combination of non-conductive materials including but not limited to polymers, glass, and ceramics). In one embodiment, electrically insulative components, such as, e.g., support wafer 64, insulator 82, and insulative carrier 128 are formed of a polymeric material by methods such as injection molding, extrusion, casting, machining, and the like, while electrically conductive components, such as e.g., electrical contact 14, shield element 80, socket contact 84, and at least one of interlocking plates 10 are formed of metal by methods such as molding, casting, stamping, machining, and the like. Some components described herein, such as, e.g., insertion element 50 and tool 150, may be formed of a polymeric material or metal as suitable for the intended application. Material selection will depend upon factors including, but not limited to, chemical exposure conditions, environmental exposure conditions including temperature and humidity conditions, flame-retardancy requirements, material strength, and rigidity, to name a few.

Although specific embodiments have been illustrated and described herein for purposes of description of the preferred embodiment, it will be appreciated by those of ordinary skill in the art that a wide variety of alternate and/or equivalent implementations calculated to achieve the same purposes may be substituted for the specific embodiments shown and described without departing from the scope of the present invention. Those with skill in the mechanical, electro-mechanical, and electrical arts will readily appreciate that the present invention may be implemented in a very wide variety of embodiments. This application is intended to cover any adaptations or variations of the preferred embodiments discussed herein. Therefore, it is manifestly intended that this invention be limited only by the claims and the equivalents thereof.

What is claimed is:

1. An electrical connector assembly comprising:

an insulative carrier;

a plurality of termination devices supported in the insulative carrier, each termination device comprising:

an electrically conductive outer shield element having a front end and a back end, the shield element having a latch member extending therefrom and a plurality of termination legs extending from the back end, wherein the termination legs extend from the back end such as to interdigitate with termination legs of a shield element of an adjacent termination device, and wherein the termination legs comprise one or both of surface-mount termination legs and through-hole termination legs;

an insulator disposed within the shield element; and a socket contact supported within and electrically isolated from the shield element by the insulator, the socket contact configured for making electrical connections through the front end and back end of the shield element and having a termination end extending beyond the back end of the shield element, wherein the insulative carrier includes a plurality of carrier walls defining an array of apertures shaped to receive the plurality of termination devices.

2. The electrical connector assembly of claim 1, wherein the termination end comprises one of a surface-mount termination end and a through-hole termination end.

3. The electrical connector assembly of claim 1, wherein the termination legs and the latch member are configured to cooperatively retain the termination device in the insulative carrier.

4. The electrical connector assembly of claim 1, wherein the carrier walls include a plurality of wall portions connected by frangible wall sections.

5. The electrical connector assembly of claim 1, wherein the insulative carrier is customized to provide a desired carrier configuration.

6. The electrical connector assembly of claim 1, wherein the insulative carrier comprises an overmolded carrier.

7. The electrical connector assembly of claim 1, wherein the insulative carrier includes a plurality of alignment posts and standoffs.

8. A tool suitable for use with an electrical connector assembly comprising:

an insulative carrier;

a plurality of termination devices supported in the insulative carrier, each termination device comprising:

an electrically conductive outer shield element having a front end and a back end, the shield element having a latch member extending therefrom and a plurality of termination legs extending from the back end, wherein the termination legs extend from the back end such as to interdigitate with termination legs of a shield element of an adjacent termination device, and wherein the termination legs comprise one or both of surface-mount termination legs and through-hole termination legs;

an insulator disposed within the shield element; and a socket contact supported within and electrically isolated from the shield element by the insulator, the socket contact configured for making electrical connections through the front end and back end of the shield element and having a termination end extending beyond the back end of the shield element, wherein the insulative carrier includes a plurality of carrier walls defining an array of apertures shaped to receive the plurality of termination devices, the tool comprising:

a body portion;

a head portion extending from the body portion and shaped for insertion into the carrier, the head portion including a channel shaped to receive and remove a wall portion of the carrier.

9. An electrical connector system comprising:

an electrical connector assembly comprising:

an insulative carrier;

a plurality of termination devices supported in the insulative carrier, each termination device comprising:

an electrically conductive outer shield element having a front end and a back end, the shield element having a latch member extending therefrom and a plurality of termination legs extending from the back end, wherein the termination legs extend from the back end such as to interdigitate with termination legs of a shield element of an adjacent termination device, and wherein the termination legs comprise one or both of surface-mount termination legs and through-hole termination legs;

an insulator disposed within the shield element; and a socket contact supported within and electrically isolated from the shield element by the insulator, the socket contact configured for making electrical connections through the front end and back end of the shield element and having a termination end extending beyond the back end of the shield element, wherein the insulative carrier includes a plurality of carrier walls defining an array of apertures shaped to receive the plurality of termination devices; and an electrical connector comprising:

a plurality of interlocking plates at least one of which is electrically conductive, the interlocking plates defining a plurality of cavities, each cavity sized for accepting a termination device; and at least one electrical contact positioned within a cavity, electrically isolated from the interlocking plates, and configured to mate with a socket contact of the termination device, wherein the electrical connector assembly and the electrical connector are configured such that the socket contact of each termination device makes electrical contact with a corresponding electrical contact of the electrical connector and the shield element of each termination device makes electrical contact with the interlocking plates of the electrical connector when the electrical connector assembly and the electrical connector are in a mated configuration.

10. The electrical connector system of claim 9, wherein the electrical connector further comprises an insulative support wafer, and wherein the plurality of interlocking plates and the at least one electrical contact are supported by the support wafer.

* * * * *

UNITED STATES PATENT AND TRADEMARK OFFICE

CERTIFICATE OF CORRECTION

PATENT NO. : 7,850,489 B1
APPLICATION NO. : 12/538778
DATED : December 14, 2010
INVENTOR(S) : Steven Feldman It is certified that error appears in the above-identified patent and that said Letters Patent is hereby corrected as shown below:

Column 2,
Line 61, delete "12," and insert --12.-- therefor.

Column 3,
Line 12 (approximately), delete "exemplary," and insert --exemplary-- therefor.

Column 3,
Line 47, delete "33a-33h" and insert --33a-33b-- therefor.

Column 4,
Line 9, delete "as" and insert --as,-- therefor.

Column 4,
Line 16, delete "10" and insert --10,-- therefor.

Column 4,
Line 31 (approximately), delete "as" and insert --as,-- therefor.

Column 7,
Line 15, delete "multi-support" and insert --multi-cavity support-- therefor.

Column 13,
Line 55, delete "as" and insert --as,-- therefor.

Column 16,
Line 17, delete "as" and insert --as,-- therefor.

Signed and Sealed this
Ninth Day of August, 2011

David J. Kappos

David J. Kappos
*Director of the United States Patent and Trademark Office*